US011065518B2

(12) United States Patent
Sharum

(10) Patent No.: US 11,065,518 B2
(45) Date of Patent: Jul. 20, 2021

(54) HANDLE GRIP CONTROL DEVICE

(71) Applicant: Richard Andrew Sharum, Garland, TX (US)

(72) Inventor: Richard Andrew Sharum, Garland, TX (US)

( * ) Notice: Subject to any disclaimer, the term of this patent is extended or adjusted under 35 U.S.C. 154(b) by 0 days.

(21) Appl. No.: 16/435,524

(22) Filed: Jun. 9, 2019

(65) Prior Publication Data

US 2019/0290984 A1 Sep. 26, 2019

Related U.S. Application Data

(63) Continuation-in-part of application No. 15/608,382, filed on May 30, 2017, now Pat. No. 10,335,658, which is a continuation-in-part of application No. 15/429,499, filed on Feb. 10, 2017, now abandoned.

(51) Int. Cl.

| | |
|---|---|
| ***A63B 59/00*** | (2015.01) |
| ***A63B 69/00*** | (2006.01) |
| ***A63B 60/12*** | (2015.01) |
| ***A63B 59/50*** | (2015.01) |
| ***A63B 60/14*** | (2015.01) |
| *A63B 102/18* | (2015.01) |

(52) U.S. Cl.

CPC ..... *A63B 60/12* (2015.10); *A63B 59/50* (2015.10); *A63B 60/14* (2015.10); *A63B 2102/18* (2015.10); *A63B 2209/00* (2013.01)

(58) Field of Classification Search

CPC . A63B 69/0002; A63B 59/50; A63B 2102/18; A63B 2069/0008; A63B 60/14; A63B 60/12; A63B 2209/00

USPC ..... 473/422, 457, 437, 568, 203, 523, 538, 473/552, 549

See application file for complete search history.

(56) References Cited

U.S. PATENT DOCUMENTS

| | | | | |
|---|---|---|---|---|
| 1,822,212 | A | 9/1931 | Griffiths | |
| 2,160,656 | A | 5/1939 | Hall | |
| RE21,439 | E | 4/1940 | Link | |
| 2,223,437 | A | 12/1940 | Yeager, Jr. | |
| 2,437,404 | A | 3/1948 | Robinson | |
| 3,256,023 | A | 6/1966 | Frazelle | |
| 3,606,325 | A | 9/1971 | Lamkin | |
| 3,860,243 | A | 1/1975 | Prisco, Sr. | |
| 4,072,311 | A | 2/1978 | Bertucci | |
| 4,185,375 | A | 1/1980 | Brown | |
| 4,213,609 | A | 7/1980 | Swanson | |
| 4,376,536 | A * | 3/1983 | Martin | A63B 53/14 473/203 |

(Continued)

*Primary Examiner* — Mitra Aryanpour
(74) *Attorney, Agent, or Firm* — Clayton, McKay & Bailey, PC

(57) ABSTRACT

A handle grip control device configured to be removably secured to a handle of an instrument includes a body having a first outer surface and an inner surface, and a protrusion extending radially outwardly from a respective proximal end at the first outer surface of the body to a distal tip. The inner surface defines a cavity configured to receive handles of instruments, and the protrusion can define a second outer surface that includes a first and second sloped surfaces opposite to a bottom surface. A slope of the first sloped surface defines a first angle relative to a plane that is perpendicular to a longitudinal axis of the body, and a slope of the second sloped surface defines a second angle relative to the plane that is greater than the first angle.

20 Claims, 19 Drawing Sheets

(56) References Cited

U.S. PATENT DOCUMENTS

| | | | | | |
|---|---|---|---|---|---|
| 4,850,079 | A * | 7/1989 | Thompson | B25D 1/00 16/421 |
| 4,961,572 | A | 10/1990 | Badillo | |
| 5,299,802 | A | 4/1994 | Bouchet-Lassale | |
| 6,017,283 | A | 1/2000 | Hagey | |
| 6,152,831 | A * | 11/2000 | Arcenas | A63B 53/14 473/206 |
| 6,406,387 | B1 | 6/2002 | Ryan | |
| 7,160,216 | B2 | 1/2007 | Failla Colonnello Seppi | |
| 7,201,683 | B2 | 4/2007 | Estape | |
| 7,878,930 | B2 | 2/2011 | Leinert | |
| 8,167,744 | B2 | 5/2012 | Silvain | |
| 8,602,925 | B1 | 12/2013 | Rickon | |
| 9,101,810 | B2 | 8/2015 | Carlson | |
| 9,498,690 | B2 | 11/2016 | Carlson | |
| 10,335,658 | B1 * | 7/2019 | Sharum | A63B 60/14 473/457 |
| 2005/0202910 | A1 | 9/2005 | Blount | |
| 2007/0254753 | A1 | 11/2007 | Bleecker | |
| 2008/0015041 | A1 | 1/2008 | Ryan | |
| 2015/0367210 | A1 | 12/2015 | Long | |

* cited by examiner

HANDLE GRIP CONTROL DEVICE

CROSS REFERENCE TO RELATED APPLICATIONS

This application is a continuation-in-part application of application Ser. No. 15/608,382, filed May 30, 2017, which is a continuation-in-part application of application Ser. No. 15/429,499, filed Feb. 10, 2017, the entireties of which are hereby incorporated by reference.

FIELD OF THE DISCLOSURE

The present invention relates generally to instruments that include handles that are gripped by users to manipulate, or otherwise use the instruments. In particular, the present disclosure relates to a handle grip control device that can be secured to a handle of one of these instruments, and counteract various forces to steady a hand or hands relative to the instrument during its use.

BACKGROUND

Sporting equipment is well known in the art and enables players to participate in games that require instruments such as baseball, tennis, golf and the like. For example, FIG. 15 depicts a conventional baseball bat 1501 having a cylindrical barrel 1503 rigidly attached to a cylindrical grip 1505. The grip 1505 terminates at a knob 1507 that extends radially outward from the grip 1505 to ensure that a player's hands do not slip off the bat. The player holds the bat by the grip and swings the barrel at a baseball.

One of the problems commonly associated with this type of instrument, is its limited efficiency. For example, while hitting a baseball the player tries to control where the ball will go. The cylindrical shape of the grip reduces the force that a player can apply to the baseball bat to direct the ball out to the field. Further, an ability of an individual to steady their hands is not optimized with the cylindrical shape of the grip illustrated.

Accordingly, although great strides have been made in the area of baseball bats, many shortcomings remain.

SUMMARY

Examples described herein include a handle grip control device ("handle device") configured to be removably secured to a handle of an instrument. In one example, the handle device can include a body having a first outer surface and an inner surface, and a protrusion extending radially outwardly from a respective proximal end at the first outer surface of the body to a distal tip. The inner surface may define a cavity configured to receive handles of instruments. The protrusion can define a second outer surface that includes a first sloped surface, a second sloped surface, and a bottom surface opposite to the first and second sloped surfaces. In one example according to the present disclosure, the first sloped surface can extend over a first length from the proximal end, and the second sloped surface extends over a second length from an end of the first length to the distal tip. A slope of the first sloped surface defines a first angle relative to a plane that is perpendicular to a longitudinal axis of the body, and a slope of the second sloped surface defines a second angle relative to the plane that is greater than the first angle.

In one example of the present disclosure, a handle device can include a body having a first outer surface and an inner surface, a protrusion extending radially outwardly from a respective proximal end at the first outer surface to a distal tip, and an extended collar that extends vertically from the body along a longitudinal axis of the body. According to one aspect of the present disclosure, the body extends a first distance from a bottom end of the handle device to a transition defined between the body and the extended collar, and a second distance between a vertical position of the distal tip along the longitudinal axis and a position of the bottom end is greater than or equal to a value of the first distance. In addition, the extended collar can extend from the transition to a top end of the handle device over a third distance that is at least twice the second distance.

In yet another example, a handle device can include a body having a first outer surface and an inner surface, and a protrusion extending radially outwardly from a respective proximal end at the first outer surface of the body to a distal tip. Further, the body can extend from a first end to a second over a first distance along a longitudinal axis of the body. A second distance that is at least equal to the first distance, is may be defined between a vertical position of the distal tip along the longitudinal axis, and a position of the second end along the longitudinal axis. According to one aspect of the present disclosure, the protrusion can define a second outer surface that includes a bottom surface, and at least one curved surface that is opposite to the bottom surface, and disposed between the proximal end and the distal tip. According to a further aspect of the present disclosure, the body and the protrusion can define a monolithic structure formed from an elastic material.

Both the foregoing general description and the following detailed description are exemplary and explanatory only and are not restrictive of the examples, as claimed.

DESCRIPTION OF THE EXAMPLES

Reference will now be made in detail to the present examples, including examples illustrated in the accompanying drawings. Wherever possible, the same reference numbers will be used throughout the drawings to refer to the same or like parts.

Figure 1:
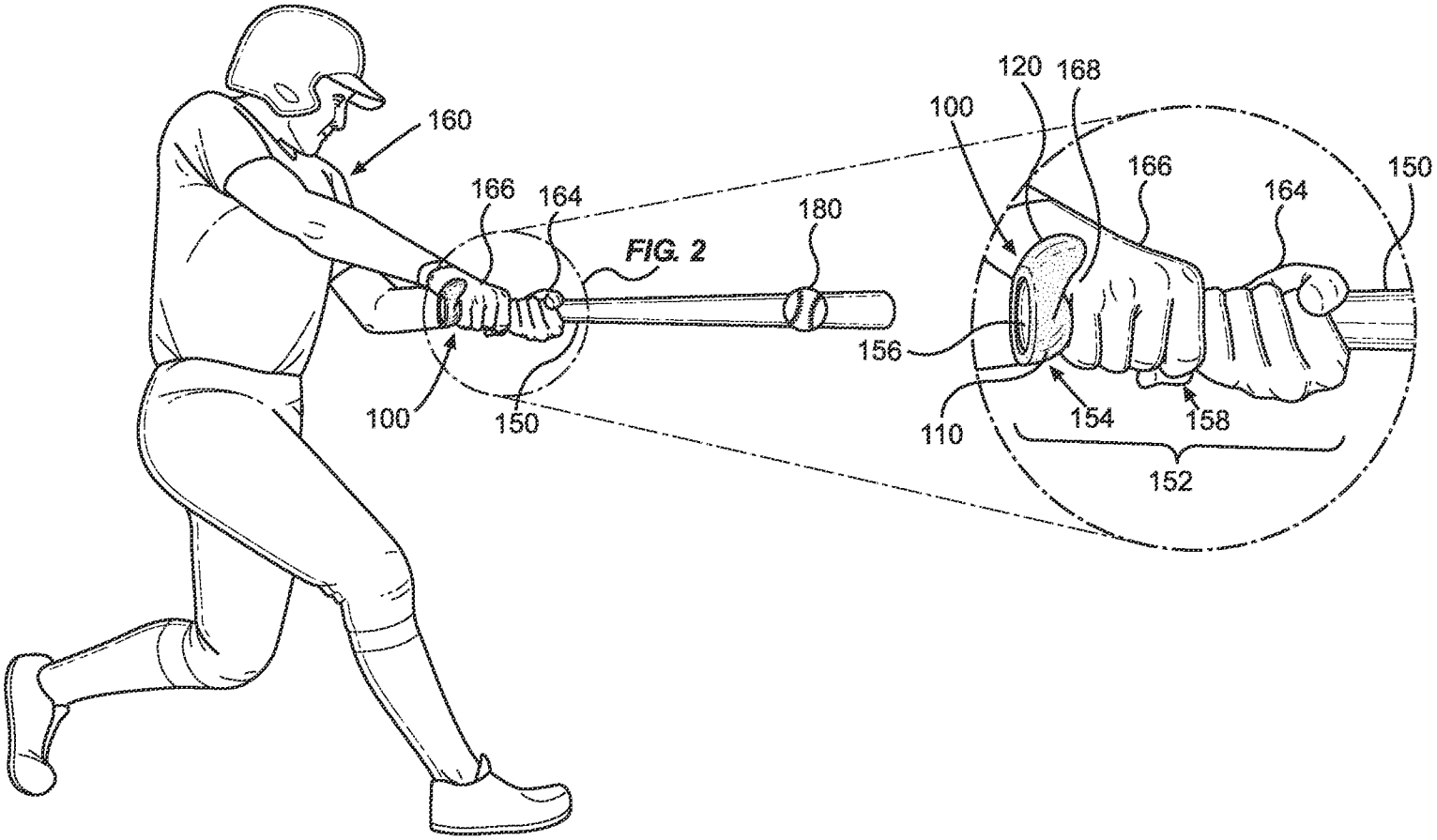
FIG. 1 illustrates an exemplary implementation of a handle device according to an aspect of the present disclosure.

A handle grip control device 100 (hereafter referred to as "handle device 100") 100 of the present disclosure includes a body 110 and a protrusion 120. Aspects of the handle device 100 of the present disclosure are described herein with reference to an exemplary implementation of the handle device 100 with a bat 150, as illustrated in FIG. 1, which is suitable for playing baseball. However, as discussed below, the handle device 100, and in particular the body 110, can be sized for, secured to, and implemented with a multitude of instruments that include a handle.

As defined herein, an instrument to which examples of a handle device, such as handle device 100, can be secured, is an object that generally includes a handle end from which a shaft extends to an opposite end. The shaft of the instrument could be a continuous shaft that does not include a tool component. Further, the continuous shaft of the instrument may have a non-uniform cross-section as the shaft extends to an opposite end, as is the case in FIG. 1. In another example, the shaft may have a uniform cross-section. As in the example illustrated in FIG. 1, a handle device of the present disclosure can be secured to a handle end of an instrument that is appropriate for use in sports activities, such as baseball.

In yet another example, an end opposite to a handle end of an instrument that incorporates a handle device of the present disclosure may be provided with: a tool component such as a head of a hammer or a mallet of a meat tenderizer; other sports equipment devices such as a head of a tennis racquet, a racquet ball racquet, or a lacrosse stick; a cooking tool component such as a blade of a knife or a meat cleaver, or a scoop for an ice cream disher; or various surgical instruments. Examples of a handle device described herein may be incorporated in similar types of instruments as mentioned above that are used in various sports or fields of work such as building and construction, medicine, and the culinary arts.

Turning to the example in FIG. 1, the body 110 of the handle device 100 is configured to secure the handle device 100 to the bat 150. A user 160 grips the bat 150 with both left and right hands 164, 166 at a handle 152. As shown in the close-up provided in FIG. 1, an outer portion 168 of a user's hand (hereafter referred to as a "base 168" of a hand) may rest on an upper surface of the protrusion 120 when the bat 150 is being used to hit, for example, a baseball 180.

As described in more detail with reference to FIGS. 3A-3C and 4, the bat 150 includes the handle 152 (covered by hands 164, 166 of the user 160) that is defined by: (A) a proximal end 154 (hereafter referred to as "handle end 154") of the bat 150 which includes an end-face 156; and (B) a portion of a shaft (e.g., a cylindrical shaft) that extends from the handle end 154 that includes as least a proximal end of the shaft immediately attached or operatively connected to the handle end 154 (hereafter referred to as "proximal shaft 158" or "shaft connection end 158"). In one example, the handle end 154 has a shape (e.g., cross-sectional shape), that is different from a shape of the proximal shaft 158.

Examples of handle devices described herein, such as the handle device 100, may be formed from a flexible material such as rubber. Further, handle devices described herein may include a body, such as body 110, having an inner surface that defines a cavity configured to receive at least a handle end of one or more types of instruments, such as the bat 150. The combination of flexible material and a shape of the inner surface provides a body that is configured to tightly fit on to, and match the contour of, a surface of a handle end of an instrument.

The capability of a body, such as body 110, to tightly fit a handle device, such as handle device 100, onto an instrument, such as the bat 150, enables the handle device to support a user's hand, and remain on the instrument during a single and abrupt use of the instrument. Thus, even for implementations that include instruments being swung with substantial force, such as the bat 150 when attempting to hit the baseball 170 a substantial distance (e.g., 300 or more feet), a handle device of the present disclosure will remain secured to the instrument in such a way as to provide continuous support to the user's hand throughout the single use (e.g., a swing).

In practice, and as shown in FIG. 1, a base of a user's hand, such as base 168, that may be supported by the protrusion 120, may correspond to an abductor digiti minimi muscle of a hypothenar muscle group of that hand. Thus, an interaction with a handle device may include a portion of a hand, which includes an abductor digiti minimi muscle, comfortably resting: (A) on an upper surface of a protrusion, such as protrusion 120; (B) between a distal end of the protrusion and a proximal shaft of an instrument handle; (C) during a forceful use of the instrument. Advantages of this interaction will be discussed in more detail in reference to FIG. 2 and throughout.

Figure 2:
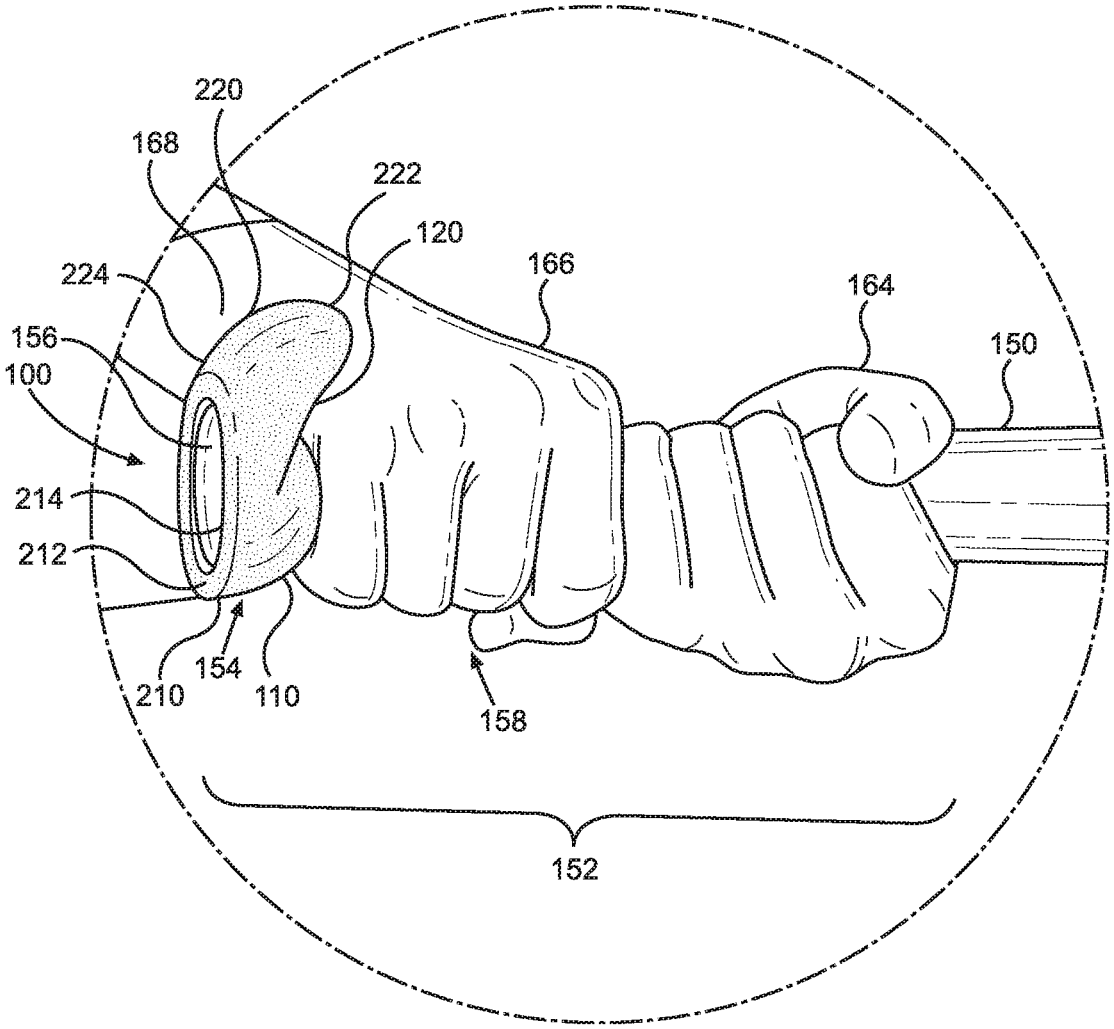
FIG. 2 illustrates a closeup of FIG. 1 designated as Detail 2.

FIG. 2 provides an enlarged view of the closeup provided in FIG. 1. As shown, the left and right hands 164, 166 of the user 160 grip the handle 152 of the bat 150. The handle device 100 is secured to the handle end 154, with the protrusion 120 supporting, at a minimum, the base 168 of the right hand 166. The body 110 of the handle device 100 surrounds, and conforms to, the handle end (not shown), and includes a first outer surface 210 that extends to an outer lip 212 that is defined by a circumferential edge 214 ("edge 214"). The outer lip 212 may overlap with an outer circumferential strip of an end-face 156 of the handle end 154. As a result, the lip may enhance an ability of the handle device 100 to remain on the bat 150 when swung.

In another example, the outer lip 212 may not be provided, and the edge 214, instead of having and inward facing radial surface, includes a circular end-face that faces in a same direction as the end-face of the bat 150. In this example, the bottom edge may be positioned along a plane substantially coincident with a plane of a surface defined by the end-face 156. However, the tight form fitting of an inner surface of the body to a handle end of an instrument to which this example would be attached, provides assurance that the handle device of this example would remain on the instrument during use.

The protrusion 120 is defined by a second outer surface 220, and extends from a distal tip 222 towards the body 120 to an end portion 224 thereof that extends directly from the first outer surface (hereafter referred to as "proximal protrusion end 224"). In the example shown, a substantial portion of the base 168, corresponding to a width of the protrusion 120, rests on the second outer surface 220. In the action of swinging the bat 150 as shown, the right hand 166 will apply a significant force(s) in a direction orthogonal to a surface interface between the base 168 and protrusion 120, over a surface area of the protrusion corresponding to the area of that surface interface.

While swinging the bat in a forceful manner at the pitched ball (see FIG. 1), the handle device 100 enables the user 160 to keep his or her hands 164, 166 still and steady, relative to the handle 152. The handle device 100 assists in preventing the hands 164, 166 from over-rotating. Further, due to the curvature of the protrusion 120, the handle device 100 provides a feel and ergonomic value that promotes both hands to remain steady, and therefore produce a more accurate swing. In one example, the handle device 100 may mimic the feel and ergonomic value of swinging an axe, which may result from a configuration of a respective axe handle.

As noted above, a portion of the protrusion 120 contacts with the base 168 of the right hand 166, which is a bottom hand relative to the left hand 164 and with respect to a grip of the handle 152. A curvature of the portion of the protrusion in contact with the base may be specifically configured to feel natural and increase a level of comfort experienced by the user in his or her hands while swinging an instrument, such as the bat 150, with varying degrees of force/speed. In addition, the handle device 100 is advantageous with respect to wrist and forearm health, as it puts less pressure on those areas for such activities that incorporate swinging a bat or other similar motions executed with similar instruments. In the case of baseball, the handle device can be configured for, and accepted as, a legal batting apparatus per official baseball rules.

Figure 3C:
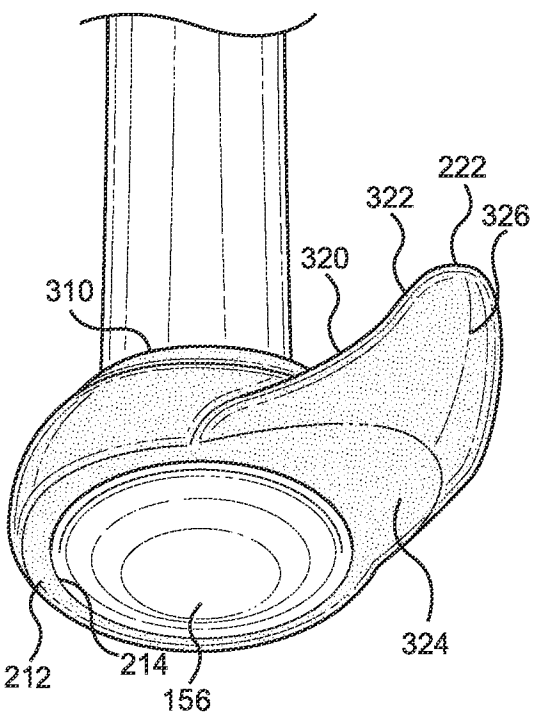
FIG. 3C illustrates a bottom perspective view of a handle and handle device.
Figure 3B:
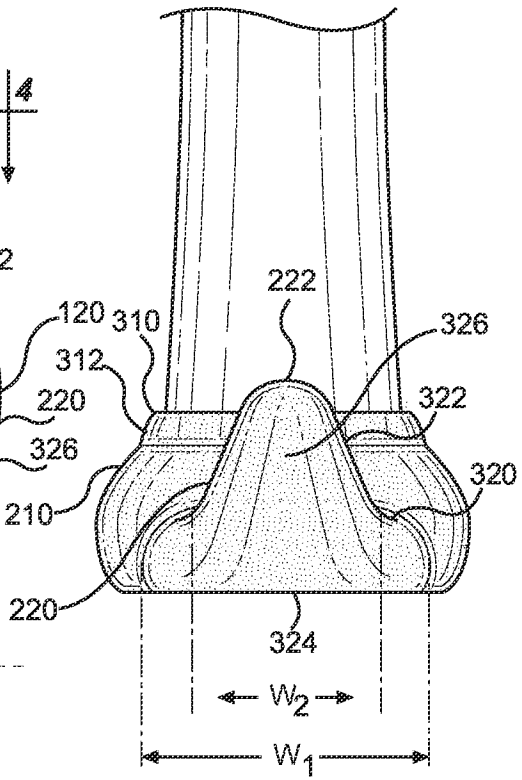
FIG. 3B illustrates a front elevation view of a handle and handle device.
Figure 3A:
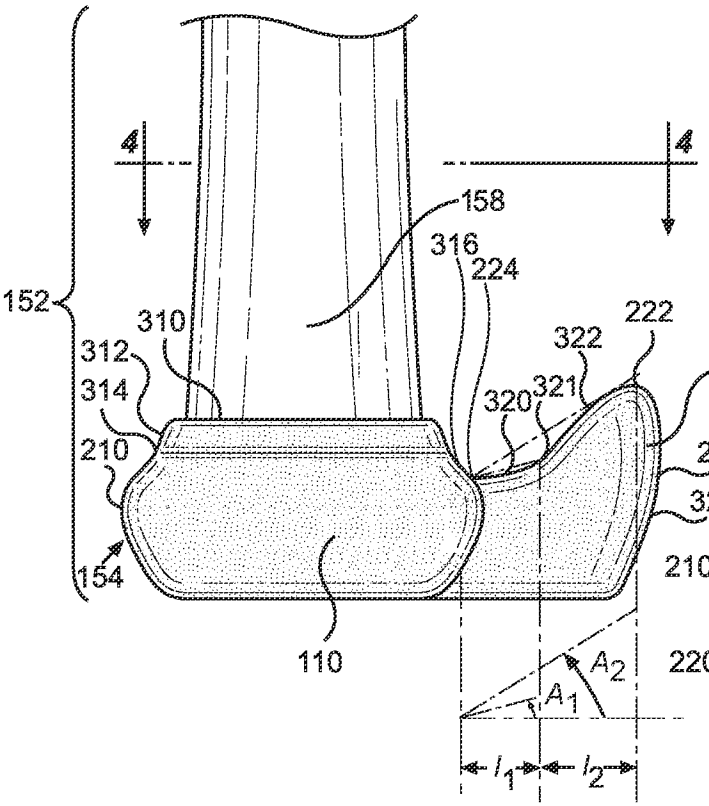
FIG. 3A illustrates a side elevation view of a handle and handle device.

FIGS. 3A, 3B, and 3C respectively illustrate side elevation, front elevation, and bottom perspective views of the handle 152 and handle device 100. With reference to FIG. 3A, the body 110 extends vertically from a first end 310, down to a second end which is defined by the outer lip 212 and the edge 214. The first outer surface 210 of the body 110 defines a main body portion and a outer collar 312. A top edge or end-face of the outer collar 312 defines the first end 310 of the body 110, and surrounds the proximal shaft 158. In one example, the outer collar 312 may be defined on a respective bottom end by a feature in the first outer surface 210 such as a groove, crease, undulation, or indentation (hereafter referred to as "surface feature 314"). In one example, the surface feature 314 defines, or is located just above, an upper end of an annular segment 316 disposed between the proximal protrusion end 224 and at least the first end 310 of the body 110 along a longitudinal axis of the body. As illustrated, the annular segment 316 defines a portion of the first outer surface 210 for which an outer circumference of the first outer surface 210 increases along the longitudinal axis in a direction extending from the first end 310 towards the proximal protrusion end 224.

Figure 4:
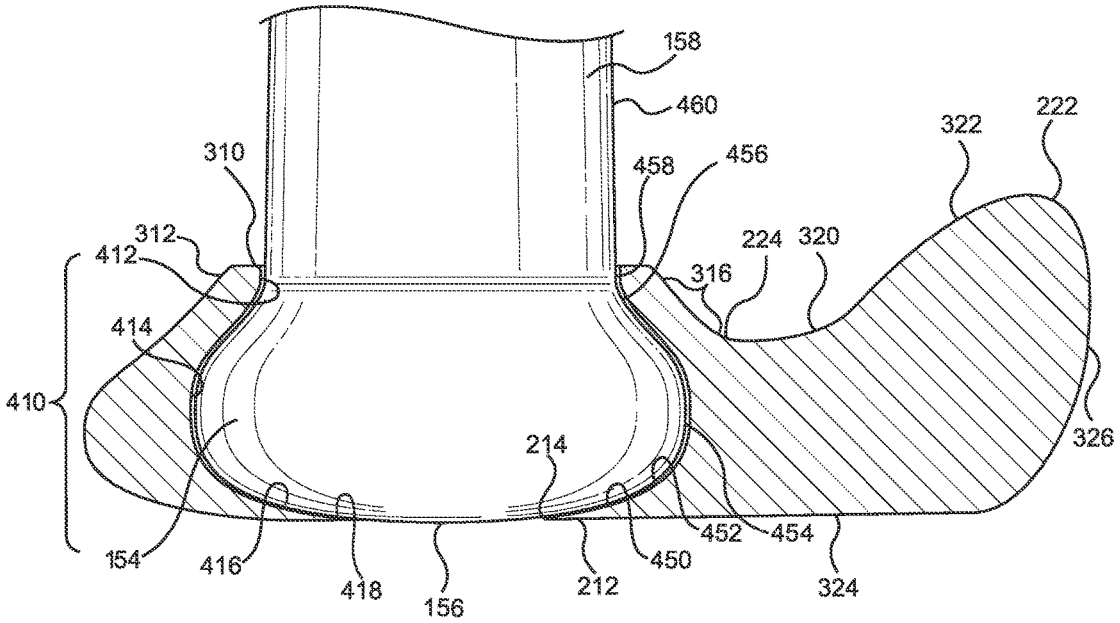
FIG. 4 illustrates a cross-sectional view of a handle and a handle device of FIG. 3A, taken along section line 4-4.

The elastic properties of the material used to for the handle device (e.g., rubber) enables an inner surface (see. FIG. 4) to conform to the shape of the handle end 154. Further, as shown, the body 110, specifically the first outer surface 210, may be configured to mimic a contour of the handle end 154. Accordingly, at least with respect to portions a user's hand in contact with the body 110 of the handle device 100, while not being in contact with the protrusion, a feel for the user is substantially the same as would be the case if the handle device 100 was not secured to the handle 152.

With further reference to FIG. 3A, a profile of the protrusion 120 is shown as being defined by the second outer surface 220. As illustrated, a first sloped surface 320 extends from the proximal protrusion end 224 at a lower end of the annular segment 316, to a transition point 321 on the second outer surface 220. A second sloped surface 322 extends from the transition point 321 to the distal tip 222 of the protrusion 120. The first sloped surface 320 extends over a first length $l_1$, and the second sloped surface extends over a second length $l_2$ of a total length of the protrusion between the proximal protrusion end 224 and the distal tip 222. An angle of inclination (a slope) of the first sloped surface 320 relative to a horizontal plane that is perpendicular to the longitudinal axis of the body 110 defines a first angle of inclination $A_1$; and an angle of inclination of the second sloped surface 320 relative to the horizontal plane defines a second angle of inclination $A_2$.

Irrespective of a surface profile of the first or second sloped surfaces, the first angle of inclination $A_1$ is defined as an angle from the horizontal plane to a straight line extending from a point on the second outer surface 220 at the proximal protrusion end 224 to a point on the second outer surface corresponding to the transition point 321. Further, the second angle of inclination $A_2$ is defined as an angle from the horizontal plane to a straight line extending from the point on the second outer surface 222 at the proximal protrusion end 224 to a point on the second outer surface 220 corresponding to the distal tip 222.

In one example, $l_2$ is slightly greater than $l_1$. In another example, the two lengths are substantially equal. However, it will be understood that various length combinations may be in a configuration of the protrusion 120 in order to accommodate a specific user. In substantially all length configurations, the first angle of inclination $A_1$ is less than second angle of inclination $A_2$. In one example, at least $A_1$ is less than 45°. In another example, both of the first and second sloped surfaces 320, 322 may be defined as curved surfaces. Further, the first sloped surface 320 may define a concave curvature, whereas the second sloped surface 322 may define a convex curvature. In one example, the variation in slope values and curvature configurations for the first and second sloped surfaces 320, 322 define a contour that provides an ergonomic value for the protrusion 120 that yields a natural feel for a user.

In addition, a third angle of inclination may be defined as an angle from: (a) a horizontal plane passing through a point on second outer surface 220 corresponding to the transition point 321, to (b) a straight line extending from the transition point 321 to the point on the second outer surface 220 corresponding to the transition point 321. In one example wherein $A_2>A_1$, the third angle maybe greater than a value of $A_1$. In another example wherein $A_2>A_1$, the third angle maybe less than a value of $A_1$.

Opposite to the first and second sloped surfaces 320, 322, a bottom surface 324 defines a flat planar surface and a bottom extent of the protrusion 120 from the proximal protrusion end 224 to just short of, or substantially equal with, a location corresponding to the distal tip 222. As illustrated, a face 326 of the protrusion 120 extends from the distal tip 222 to a start of the bottom surface 324. As illustrated, the bottom surface 324 may be provided as a flat surface that extends parallel with the horizontal plane relative to which the first and second angles of inclination $A_1$, $A_2$ are defined. In another example, the bottom surface 324 may be inclined so as to have an angle of inclination equal to the first angle of inclination $A_1$.

Turning to FIG. 3B, additional dimensional aspects of the first and second sloped surfaces 320, 322 are identified. In particular, a widest portion the first sloped surface 320, which substantially corresponds to a location of the proximal protrusion end 224, is identified as a first width $w_1$. Further, a widest portion the second sloped surface 322, which substantially corresponds to a location of the transition point 321, is identified as a second width $w_2$. As shown in FIG. 3B, $w_1$ is great than $w_2$. Both of $w_1$ and $w_2$ may be greater than a width of the protrusion at the distal tip 222, as shown in FIGS. 3A-C.

Such a graduated width (in terms of moving from the distal tip 222 to the proximal protrusion end 224) may be preferred by some users. In the configuration illustrated, a portion of the protrusion 120 that is likely to come in contact with a portion of the hand that has the least (or minimal) amount of tissue (fat or muscle) between bone and skin, has a shape with the lesser width relative to other portions of the protrusion 120. Accordingly, a footprint of the protrusion 120 in an area of the hand where an object touching that hand may be the most noticeably felt, and potentially most bothered by, is smaller relative other portions of the protrusion 120. It will be understood that different combinations of the first and second widths $w_1$, $w_2$ may be used in a configuration of the handle device 100 without affecting a capability of the handle device 100 to provide the hand steadying performance characteristics and benefits described herein.

It will be understood that depending on preferences of particular users, the first and second sloped surfaces 320, 322 could be configured with a uniform width. In yet other examples, widths of the distal tip 222 and the first and second sloped surfaces 320, 322 may be uniform.

Turning to FIG. 3C, the end-face 156 of the handle end 154 can be seen. As noted above, the outer lip 212 itself defines a second end of the body 110. As illustrated in FIG. 3C, the outer lip 212 covers an outer circumferential strip of the end-face 156 for the bat 150. This overlap aids in securing the handle device 100 to the bat 150 (in this example), can enhance a fitting of the handle device 100 around the handle end 154, and assist in maintaining a position of the handle device 100 relative to the handle 152 during abrupt and forceful swings of the bat.

FIG. 4 illustrates a cross-sectional view of the handle 152 and the handle device 100 of FIG. 3A, taken along section line 4-4. As shown, the handle device 100 includes an inner surface 410 that is composed of an inner collar 412, a middle section 414, a lower transition 416, and an inner lip 418. The inner surface 410 is configured to elastically stretch to fit around the handle end 154 of the bat 150 as illustrated. This comes as a result of a material composition of the handle device 100 (e.g., rubber) having such elastic material properties that the inner surface 410 bends and curves to tightly fit around the handle end 154 when the handle device 100 is secured to the bat 150. Accordingly, the inner surface 410 conforms to the curvature of the handle end 154 leaving little to no gap between sections of the inter surface 410 and corresponding sections of an outer surface of the handle end 154.

The outer surface of the handle end 154 may be continuous, but divided into segments for the purposes of referencing those portions of the outer surface with respect to the inner surface 410 of the handle device 100. More specifically, the outer surface of the handle end 154 may be divided into segments identified in FIG. 4 including an outer end-face 450, a diverging transition 452, an intermediate segment 454, and a converging transition 456.

In securing the handle device 100 to the bat 150, the outer end-face 450 of the handle end 154 may first be received by, or come in frictional contact with the inner collar 412. This may cause the inner collar 412 to function as a mouth opening up to receive an object. The outer end-face 450 is basically an annular region of the end-face 156 that surrounds a portion of the end-face 156 that is exposed when the handle device 100 is secured to the handle 152. As the handle end 154 is progressed further into the handle device 100, the diverging transition 452 and the intermediate segment 454 will progressively come in contact with, and spread radially outward, the inner collar 412, middle section 414, and lower transition 416.

Due to the elasticity of the body 110 of the handle device 100, the middle section 414, lower transition 416, and inner lip 418 will, respectively, come to tightly press against the intermediate segment 454, diverging transition 452, and the outer end-face 450 as the handle end 154 continues to be pushed into, or otherwise secured to the handle device 100. Further, the middle section 414 will effectively collapse, or be compressed, onto the converging transition 456 of the handle end 154 by the action of the elasticity of the body 110. In addition, the inner collar 412 will tightly fit around a neck 458 of the proximal shaft 158 that defines a portion of the proximal shaft 158 most immediately adjacent to a beginning of the curvature of the handle end 154.

As a result of the configuration of the inner surface 410 and the material composition of the body 110, the body 110 can tightly and securely be fitted onto the handle end 154 such that there is no, or a minimal at most, gap between one of: the inner collar 412 and the neck 450; the middle section 414 and the combination of the converging transition 456 and the intermediate segment 454; the lower transition 416 and the diverging transition 452; or the inner lip 418 and the outer end-face 450.

Figure 5:
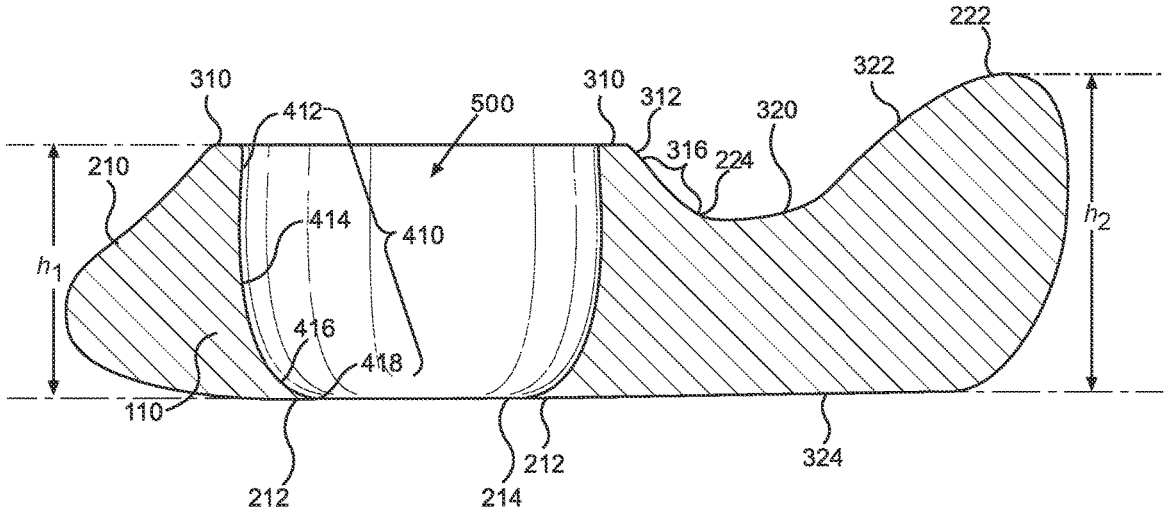
FIG. 5 illustrates a cross-sectional view of a handle device of FIG. 3A without a handle, taken along a section line corresponding to section line 4-4.
Figure 6A:
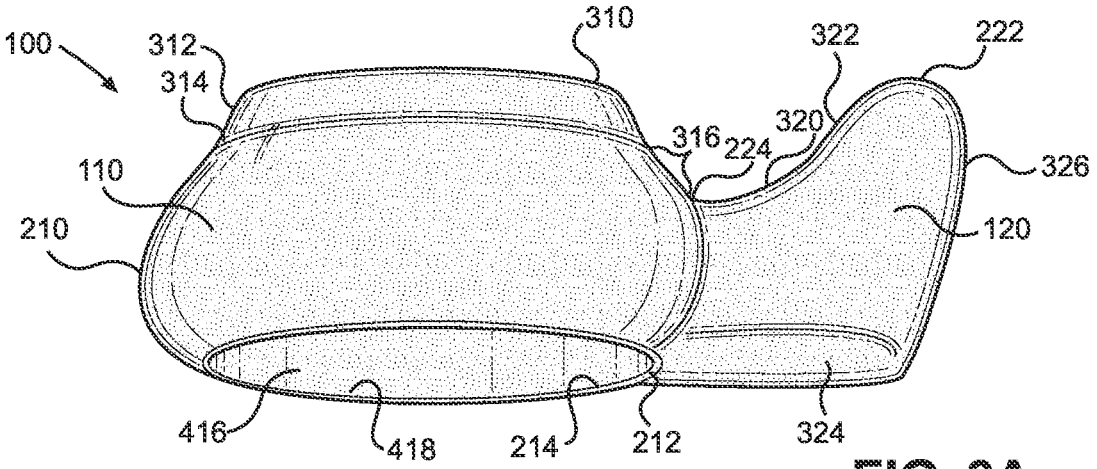
FIGS. 6A-6E respectively illustrate side, front-overhead, rear side-overhead, rear back-overhead, and bottom rear perspective views of a handle device, according to an aspect of the present disclosure.
Figure 6B:
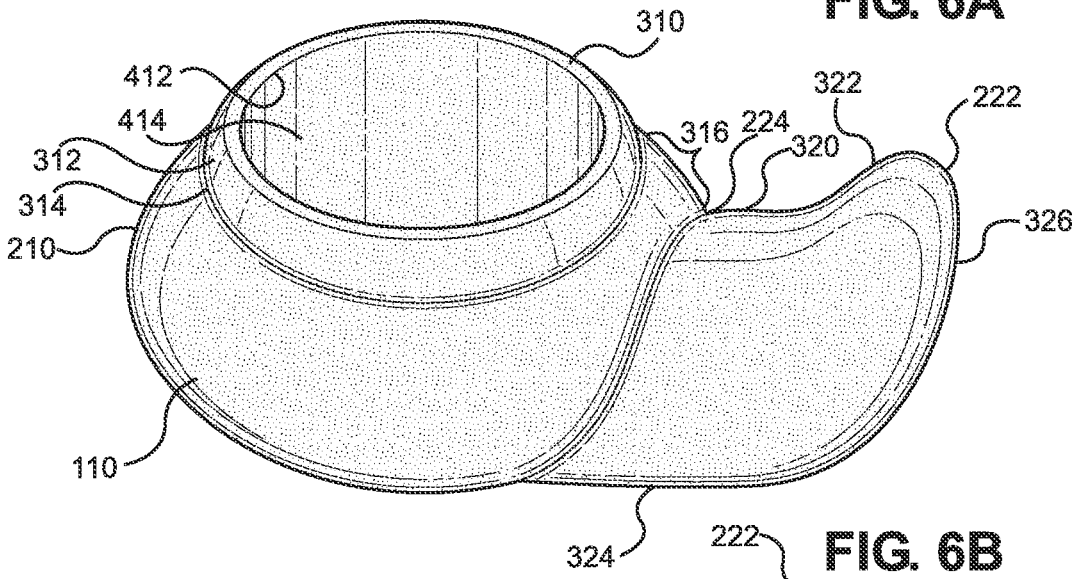
Figure 6C:
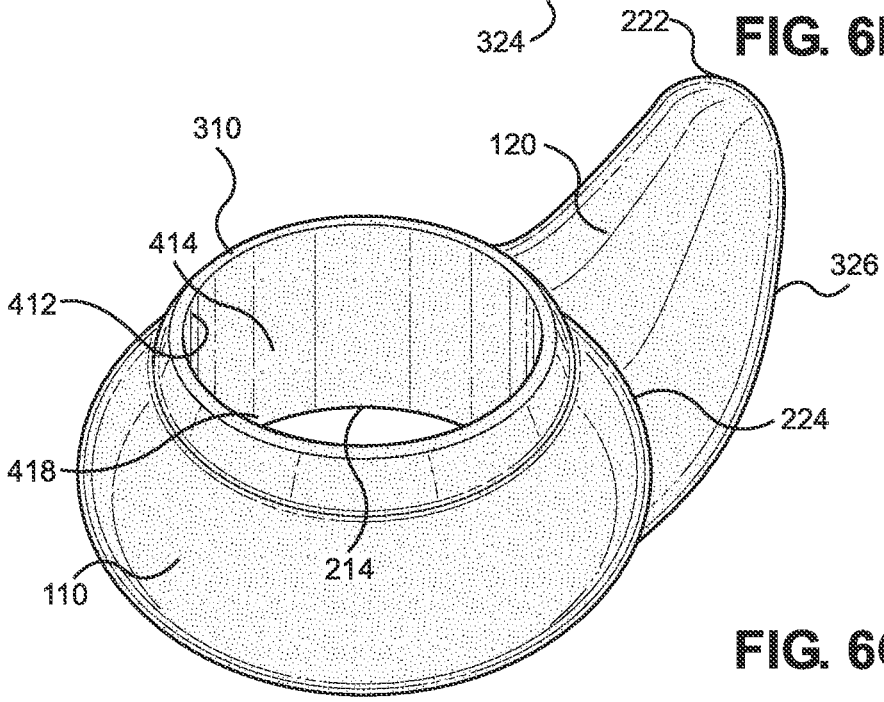
Figure 6D:
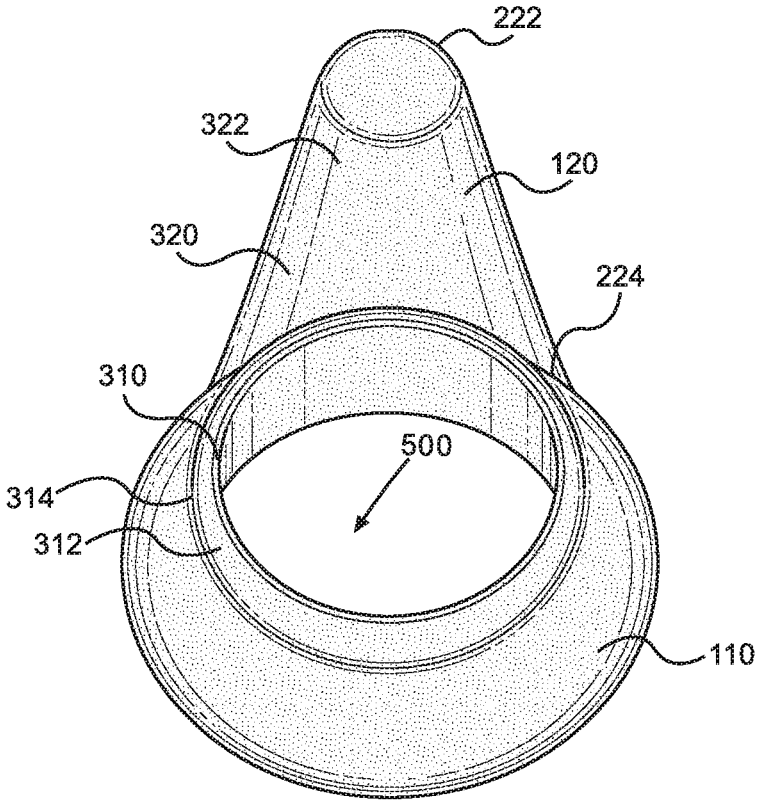
Figure 6E:
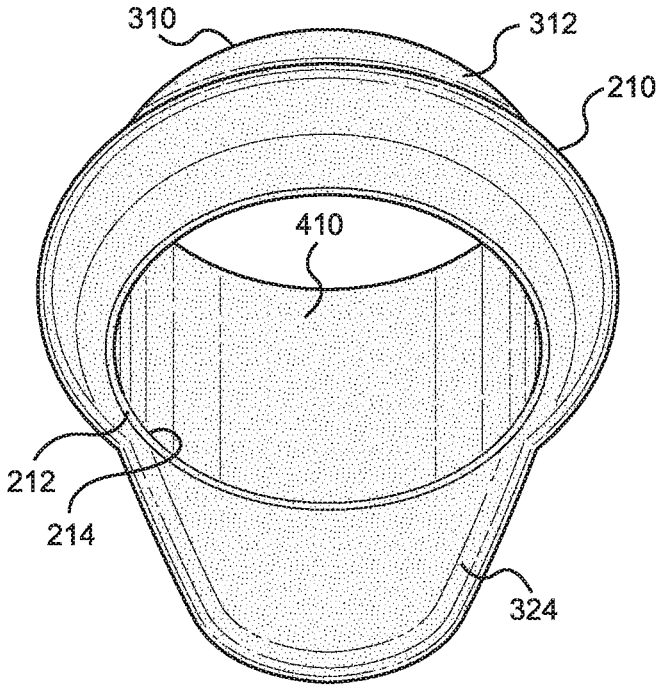

FIG. 5 illustrates a cross-sectional view of the handle device 100 of FIG. 3A without the handle 152, and taken along section line corresponding to section line 4-4. As shown, the inner surface 410 defines a cavity 500 in which a handle of an instrument, such as the bat 150, may be received. A comparison of the inner surface 410 in FIGS. 4 and 5 illustrates the elasticity of the body 110 of the handle device 110. As is clear from FIG. 5, the inner collar 412, the middle section 414 the lower transition 416 are located more radially inward relative to their respective positions in FIG. 4. Further, the inner lip 418 is more compact (less stretched out along a horizontal axis), then in the situation illustrated in FIG. 4.

It will be noted that FIGS. 4 and 5 illustrate exemplary features of the handle device 100 that provide significant advantages to a user. First, the handle device 100 does not have to be permanently attached to an instrument to achieve the benefits of comfort and accuracy. More specifically, the handle device 100 can be secured to and removed from a multitude of instruments having different shaped handles. With regards to bats, the same handle device 100 can be effectively (securely) secured to many different sized bats.

Also illustrated in FIG. 5, is one structural relationship between the body 110 and the protrusion 120. The bottom surface 324 and the outer lip 212 extend along the same horizontal plane perpendicular to the longitudinal axis of the body 110. A vertical distance from this plane to the first end 310 of the body 110 is designated as a first height $h_1$. On the other hand, a vertical distance from this plane to the distal tip 222 is designated as a second height $h_2$.

As is apparent from FIG. 5, $h_2$ is greater than $h_1$. The handle device 100 may be configured to have different combinations of the first and second heights $h_1$, $h_2$ based on the size of a handle that the handle device 100 will be secured to, and/or preferences of a user. However, one advantage of the exemplary configuration illustrated in FIG. 5 is that the combination of heights corresponds to the slope configurations of the first and second sloped surfaces 320, 322. Further, with $h_2$ sized as shown in FIG. 5, the second sloped surface 322 may serve as a backstop for a back of a hand. In one example, a distance for $h_2$ may be configured relative to a corresponding dimension of a handle end of a bat or other instrument to which the handle device 100 may be secured. Specifically, the height of the distal tip 222 ($h_2$) will be greater than a height of the handle end, to thereby help ensure the backstop functionality is provided with the application of the handle device 100.

FIGS. 6A-6E respectively illustrate side, front-overhead, rear side-overhead, rear back-overhead, and bottom rear perspective views of the handle device 100 according to the present disclosure. In particular, FIGS. 6A-6E include multiple views of the handle device 100 in a normal state prior to being secured to a handle of an instrument of one of the types previously described. Thus, FIGS. 6A-6E illustrate shapes (e.g., curvatures, sizes of undulations) for the first and second outer surfaces 210, 220 for an exemplary version of the handle device 100.

Although a specific structural configuration for the body 110, the protrusion 120, and the inner surface 410 have been described and illustrated, it will be understood that various modifications may be made to various structural sub-elements of these features. As previously noted, a differential between the first and second angles of inclination $A_1$, $A_2$ may be modified. In addition, different combinations of first and second lengths $l_1$, $l_2$, widths $w_1$, $w_2$, and heights $h_1$, $h_2$ may be employed in the construction of the handle device 100 to provide the comfort and performance benefits previously described for users of different sizes that secure the handle device 100 to instruments having handles of different structural configurations. However, it will be also noted the previously relationships between the length, width, and height dimensions are specifically configured to produce the benefits described herein in at least an application including a baseball base, such as bat 150.

In one example, the first and second outer surfaces 210, 220 may be smooth having no textural components. In another example, one or both, or parts of one or both of the outer surfaces 210, 220 may incorporate some type of textured profile to provide a different tactile sensation with portions of a user's hand that come in direct contact with the handle device.

As is apparent from the multiple views illustrated in FIGS. 6A-6E, in one example, the inner surface 410 of the handle device 100, which defines the cavity 500, may be relatively uniform and smooth. In another example of a handle device 700 illustrated in FIG. 7, an inner surface 730 may have upper, middle, and lower segments 740, 760, 780 of distinct profiles.

Figure 7:
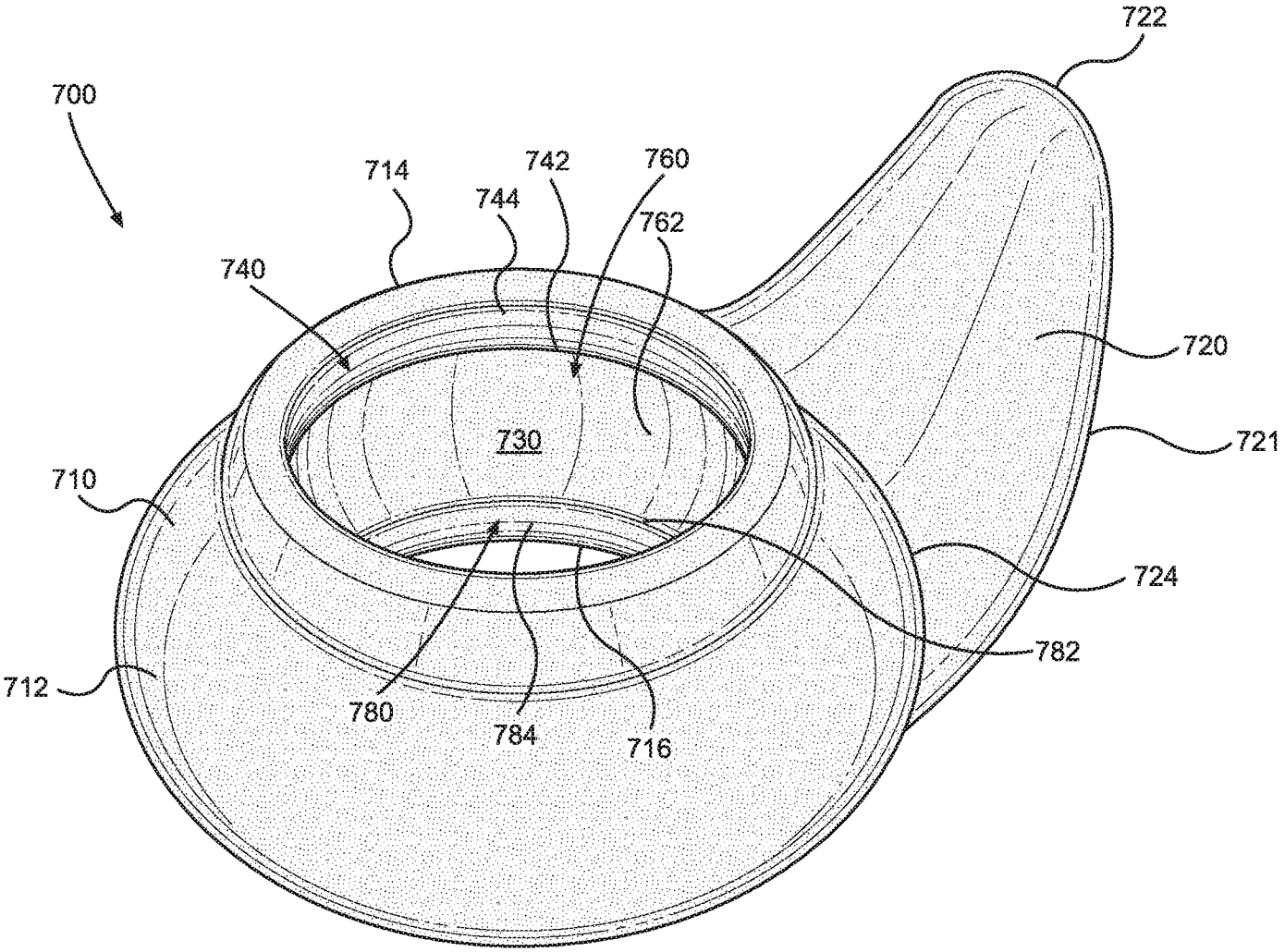
FIG. 7 illustrates a rear side-overhead perspective view of a handle device, according to an aspect of the present disclosure.

As illustrated in FIG. 7, the handle device 700 includes a body 710 that defines a first outer surface 712, and extends from a first end 714 to a second end 716. A protrusion 720 defines a second outer surface 721, and extends from a proximal protrusion end 724 to a distal tip 722. With the exception of the inner surface 730, each of the body 710 and the protrusion 720 may include the structural features of corresponding components of the handle device 100.

The upper segment 740 of the inner surface 730 includes a first ridge 742 from which a first collar 744 extends vertically to the first end 714. In one example, the first collar 744 can include a small degree of curvature defining a concave surface relative to a cavity defined by the inner surface 730. In another example, the first collar 744 may be inclined inwardly from the first ridge 742 to the first end 714 so as to define a ramped surface having a first diameter at the first end 714, and a second diameter at the first ridge 742. The first diameter being smaller than the second diameter. The upper segment 740 may incorporate either of the above configurations to correspond with structural features of a proximal shaft of a handle 700 for an instrument to which the handle device 700 is secured.

The middle segment 760 of the inner surface 730, as shown, is defined as a concave surface 762. As with the upper segment 740, a radius of curvature of the middle segment 760 may be configured in accordance with a shape of a handle end of an instrument to which the handle device 700 is secured. The concave surface 762 extends from the first ridge 742 down to a second ridge 782 which defines an uppermost extend of the lower segment 780. It will be understood that the radius of curvature (in a normal state) of the concave surface 762 may be different for different versions of the handle device 700 configured for different instruments having different handle configurations.

The lower segment 780 of the inner surface 730 includes a second ridge 782 from which a second collar 784 extends vertically down to the second end 716. In one example, the second collar 784 may be inclined inwardly from the second ridge 782 to the second end 716 so as to define a ramped surface having a first diameter at the second ridge 782, and a second diameter at the second end 716. The first diameter being smaller than the second diameter. In another example, the second collar 784 can include a small degree of curvature.

The lower segment 780 may incorporate either of the above configurations to correspond with structural features of an end face of a handle for an instrument to which the handle device 700 is secured.

In other examples of the handle device 700, either the first collar 744 or the second collar 784 may be defined by a convex surface relative to a cavity defined by the inner surface 730. In yet other examples of the handle device 700, where either collar includes an inclined surface, a direction of inclination may be opposite to a direction discussed above. In still other examples, the handle device 700 may be formed or otherwise provided without the first collar 744 or the second collar 784.

It will be noted that even though portions of the inner surface 730 may be configured to correspond to a profile of a proximal shaft and handle end of a handle, a cavity defined by the inner surface 730 will characteristically define (surround/border) a volume that is less than a volume occupied by the handle end and proximal shaft. Accordingly, during securement, the body 710 will stretch and tightly conform to an outer surface of a handle of instrument, as in the case of handle device 100. An advantage of the handle 700 however is that a combined thickness of the body 710 and a handle may be reduced for those areas where a shape of the inner surface 730 in a normal state mimics a profile of an outer surface of the handle. From a stand point of a bottom hand of a user holding an instrument including the handle device 700, a feeling of the handle device may be less noticeable for those portions of the hand that are not in contact with the protrusion (e.g. a palm, pinky finger, etc.).

Different configurations for an inner surface for a handle device of the present disclosure have been described. However, it will be noted that while some configurations may correspond to a profile of a handle end of a specific instrument, a composition of body is such that substantially all of these variations of the handle device may be secured to handles of different shapes. More specifically, the elasticity of the body for any of the examples described herein my allow any one exemplary handle device according to the present disclosure to: (A) stretch, be positioned around, and conform to a surface of, more than one handle configuration (shape of a handle end); and (B) yield the comfort and performance benefits described herein with respect to multiple types of instruments.

Figure 9:
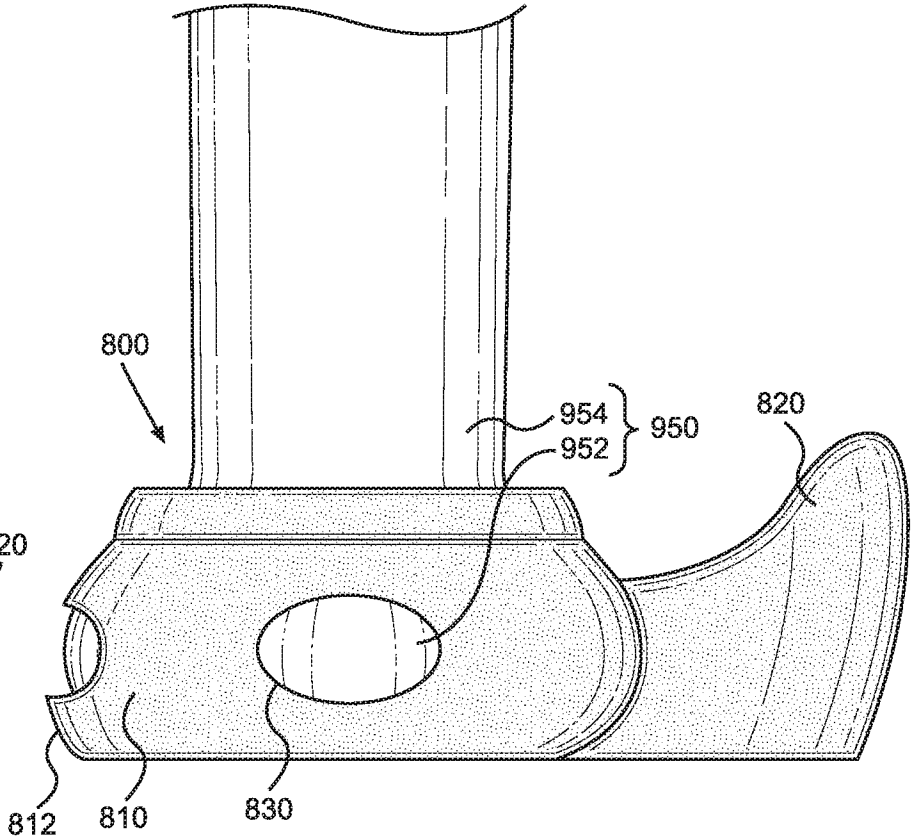
FIG. 9 illustrates a side elevation view of a handle and handle device according to an aspect of the present disclosure.
Figure 8:
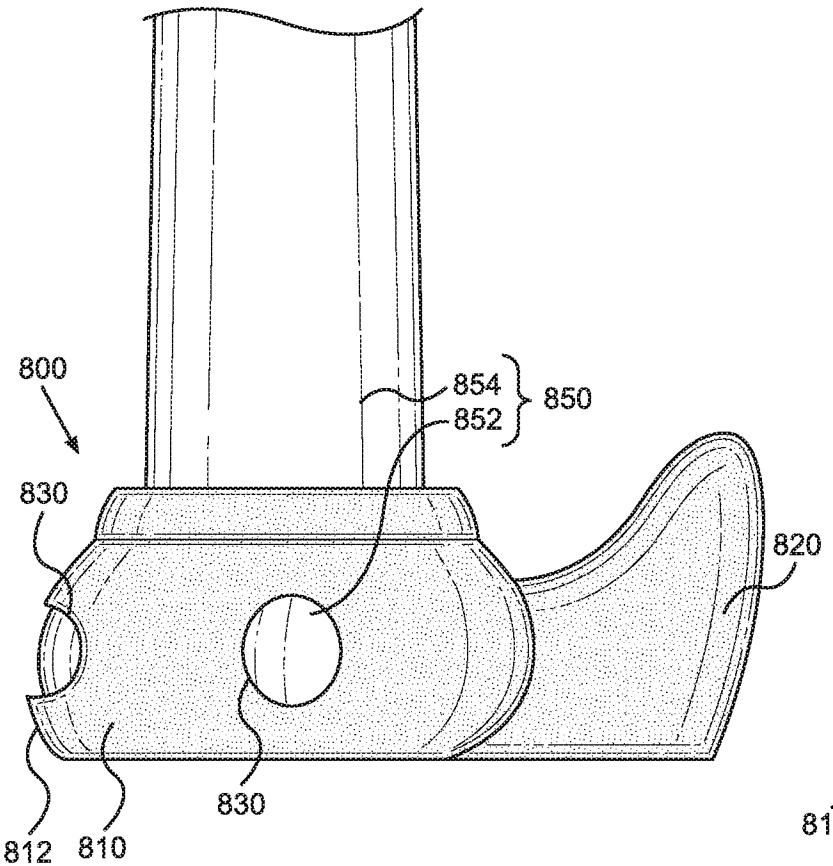
FIG. 8 illustrates a side elevation view of a handle and handle device according to an aspect of the present disclosure.

Additional features may be incorporated into a handle device according to the present disclosure that allow the handle device to be secured to a wider range of different sized handles. FIGS. 8 and 9 provide one example of one such feature for a handle device 800. The handle device 800 includes a body 810 and a protrusion 820. The protrusion 820 may be substantially similar to the protrusions of the handle device 100 of FIGS. 1 to 6E and the handle device 700 of FIG. 7. The body 810 may include any of the features described with respect to the bodies 110, 710 of each of handle devices 100, 700.

In addition, the body 810 may be provided with apertures 830 that extend through a wall defined between and including the outer surface 812 and an inner surface of the body 810. The apertures 830 allow the body 810 to stretch over, and effectively secure the handle device 800 to, a wide range of different sized handles. For example, the handle device 800 may be secured to a handle 850 of an instrument, as shown in FIG. 8; or a (different/larger) handle 950 of another instrument, as shown in FIG. 9. The handle 850 including a handle end 852 and proximal shaft 854 with noticeably smaller diameters as compared to a handle end 952 and proximal shaft 954 of the handle 950. Thus, the handle device 800 may be utilized in situations in which the same type of instrument is used, but significantly varies in size depending on the person using that type of instrument. For example, an adult engaging in chopping vegetables may use a chopping knife that is much larger than a chopping knife of the exact same configuration used for the same purpose by another individual with much smaller hands (e.g., a child) than the adult. Accordingly, where a disparity in size is very substantial between two of the same type of instrument that are used in a common environment, the handle 800 may be secured to both instruments.

Figure 10B:
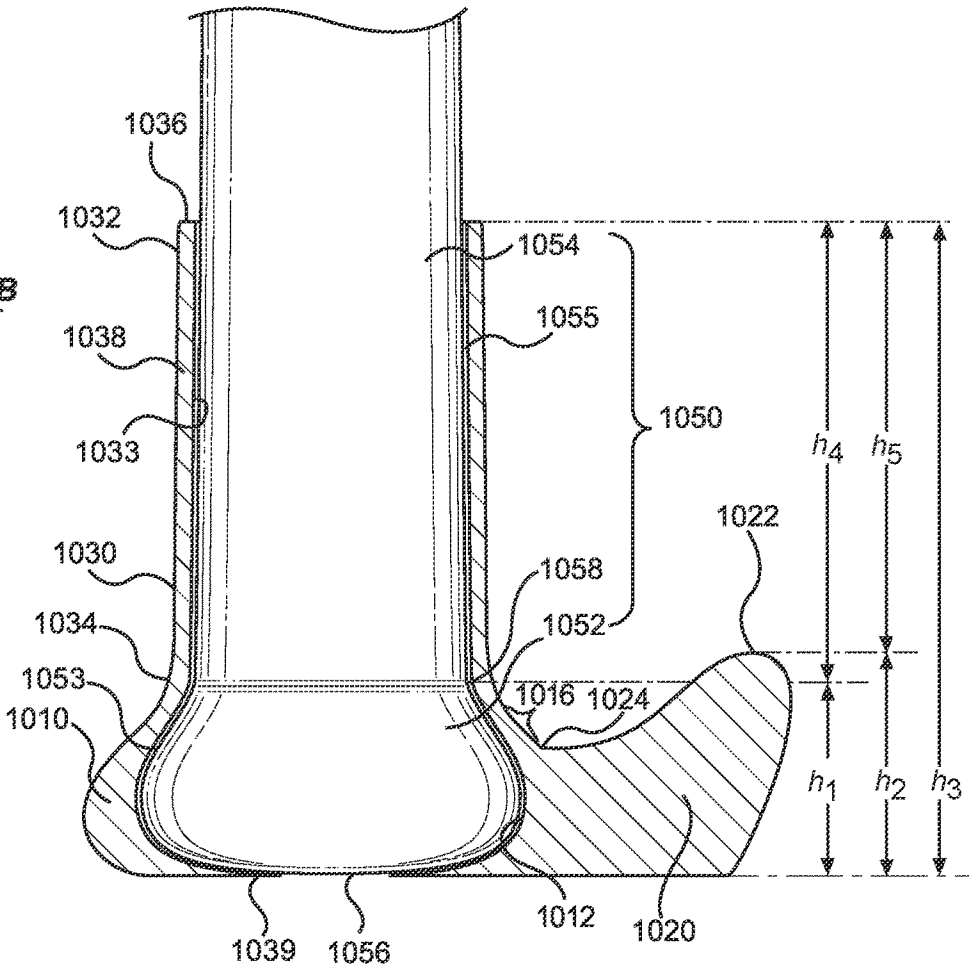
FIG. 10B illustrates a cross-sectional view of a handle and a handle device of FIG. 10A, taken along section line 10B-10B.
Figure 10A:
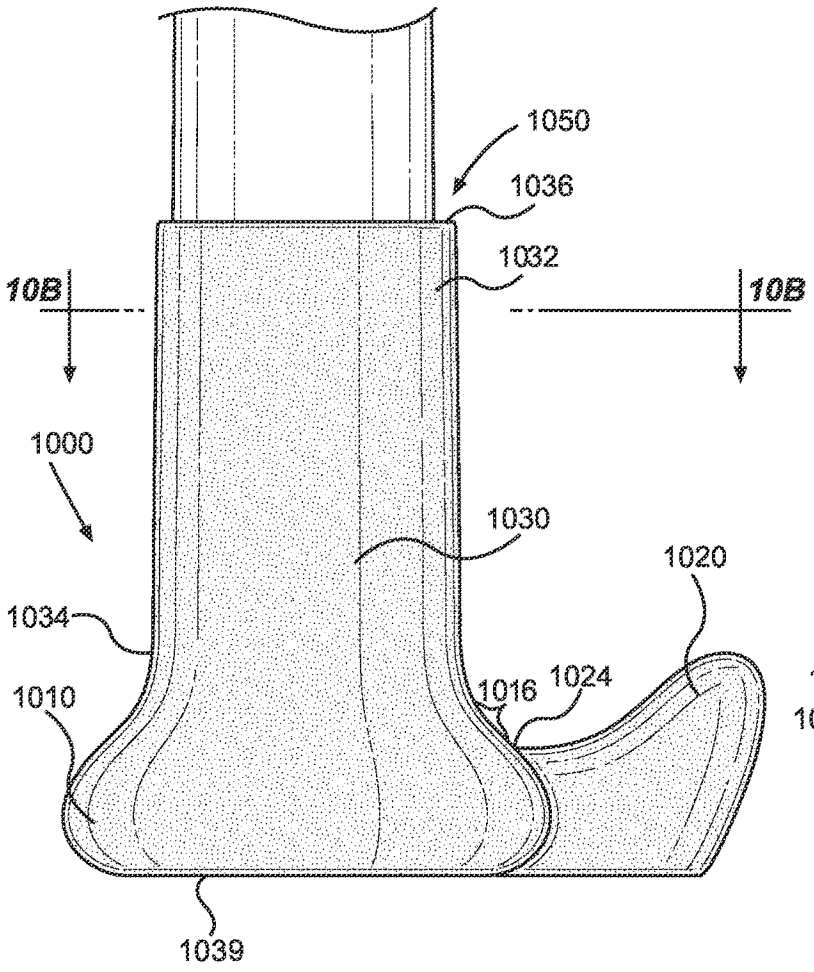
FIG. 10A illustrates a side elevation view of a handle and handle device according to an aspect of the present disclosure.

FIG. 10A illustrates a side elevation view of a handle 1050 and handle device 1000 according to an aspect of the present disclosure. FIG. 10B illustrates a cross-sectional view of the handle 1050 and a handle device 1000 of FIG. 10A, taken along section line 10-10.

The handle device 1000 includes a body 1010, a protrusion 1020 having a distal tip 1022, and an extended collar 1030 as illustrated in FIGS. 10A and 10B. The handle device 1000 extends from a first end defined by an upper end 1036 of the collar 1030, to a second end defined by an outer lip 1039 disposed at a bottom of the 1010. As shown, the body 1010 (with the exception of the collar 1030) and the protrusion 1020 (e.g., first and second sloped surface relative dimensions) are substantially similar to the body 110 and protrusion 120 of the handle device 100 of FIGS. 1 to 6E. Accordingly, the handle device 1000 is configured in such a structure, particularly from a lower end 1034 of the collar 1030 down to the second end defined by the outer lip 1039, to at least provide the comfort and swing accuracy advantages of the handle device 100. For example, the handle device 1000 includes an annular segment 1016 that defines a portion of an outer surface of the body 1010 for which an outer circumference of said outer surface increases along a longitudinal axis of the body 1010 in a direction extending from the first end of the handle device (upper end 1036) towards a proximal protrusion end 1024 of the protrusion 1020. On the other hand, any of the features of the bodies 710, 810 of the exemplary handle devices 700, 800 of FIG. 7 or 8, may be incorporated in whole or in part, into the body 1010 of the handle device 1000 without affecting the advantages provided thereby.

The handle 1050 may be the handle of an instrument of any of the types described herein, and includes a handle end 1052 and a proximal shaft 1054. The handle end 1052 extends from an end face 1056 to a neck 1058 as shown in FIG. 10B. The neck 1058 defining a transition between the proximal shaft 1054 and the handle end 1052.

The extended collar 1030 includes a collar body 1032 that extends from the upper end 1036 to a lower end 1034. The bottom surface of the body 1010, provided as a flat planar surface, and the protrusion 1020 extend along the same horizontal plane perpendicular to the longitudinal axis of the body 1010. A first vertical distance along the longitudinal axis from this plane to the lower end 1034 of the extended collar 1030 defines a height of the body 1010 and is designated as a first height $h_1$. A second vertical distance along the longitudinal axis from the plane to a location corresponding to the distal tip defines a height of the protrusion 1020 and is designated as a second height $h_2$. A third vertical distance along the longitudinal axis from the plane to a location corresponding to the upper end 1036 defines a height of the handle device 1000 and is designated as a third height $h_3$. A fourth vertical distance along the longitudinal axis extending from the point corresponding to the lower end 1034, to the location corresponding to the upper end 1036, defines a height of the extended collar 1030 and is designated as a fourth height $h_4$. Further, as illustrated in FIG. 10B, a fifth vertical distance from the distal tip 1022 to the upper end 1036 is designated as a fifth height $h_5$.

The extended collar may extend for a distance (fourth height $h_4$) that may be substantially equal to a length of the handle 1050. In one example, the fourth height $h_4$, is at least two time a value of the second height $h_2$. In another example, a value of the fourth $h_4$ for the collar body 1032 may substantially correspond to a vertical length of an area of an instrument including the handle 1050, for example a bat, that would be covered by a bottom and top hand of a user. Due to the length of the extended collar 1030, the handle device 1000 is secured to a greater portion (e.g., a larger overall surface area) of the handle 1050. In use, the extended collar 1030 may further minimize displacement of the handle device 1000 from the handle 1050, relative to examples of handle devices described herein that do not include an extended collar.

FIG. 10B provides a cross-sectional view of the handle device 1000. The body 1010 defines a first inner surface 1012, and the collar body 1032 defines a second inner surface 1033. The first inner surface 1012 being configured to surround, conform to, and tightly fit to an outer surface 1053 of the handle end 1052. Likewise, the second inner surface 1033 is configured to surround, conform to, and tightly fit to an outer surface 1055 of the proximal shaft 1054. The handle device 1000, like other examples described herein, may be formed of an elastic material that allows: the body 1010 and the collar body 1038 to stretch and receive the handle end 1052; the collar body 1038 to be pulled up the proximal shaft 1054; and the body 1010 to tightly fit around the handle end 1052. The lower end 1034 defines a transition between the collar body 1032 and the body 1010, and may be sized to have a diameter and thickness that results in no or a minimal gap between the neck 1058 and the first and second inner surfaces 1012, 1033 at the transition.

In one example, a thickness 1038 of the collar body 1032 may be substantially uniform from the lower end 1034 to the upper end 1036. In another example, the collar body 1032 may have a tapered configuration wherein a thickness at the lower end 1034 is be greater than a thickness at the upper end 1036 for the extended collar 1030.

Figure 12:
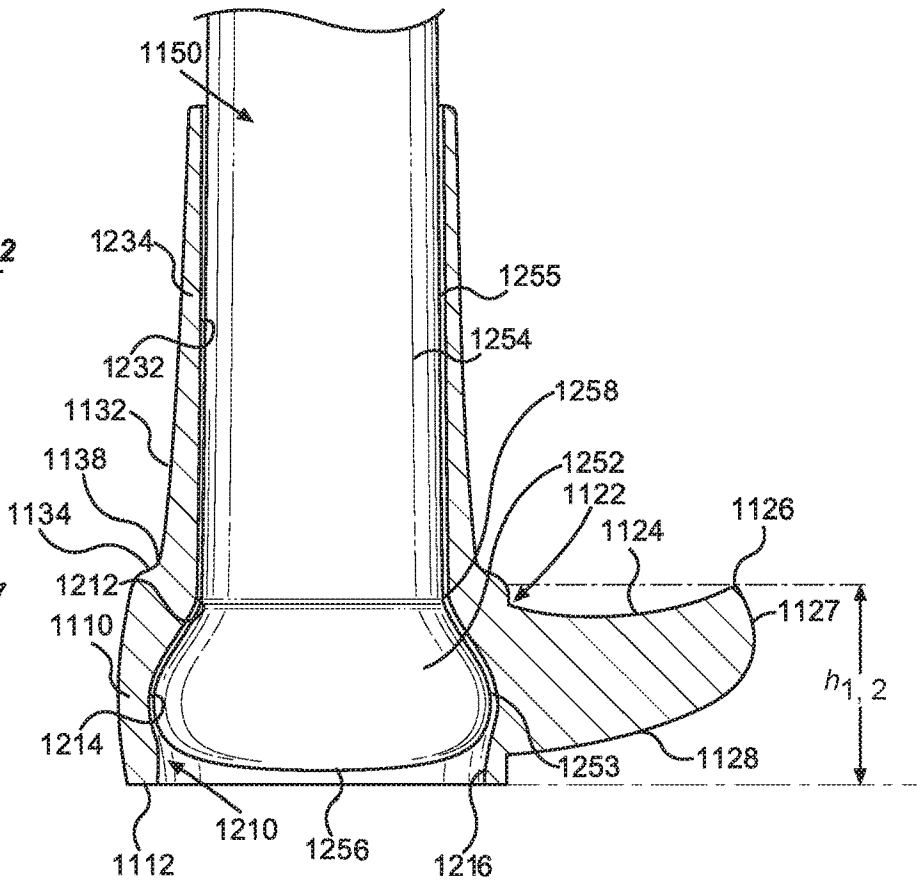
FIG. 12 illustrates a cross-sectional view of a handle and a handle device of FIG. 11, taken along section line 12-12.
Figure 11:
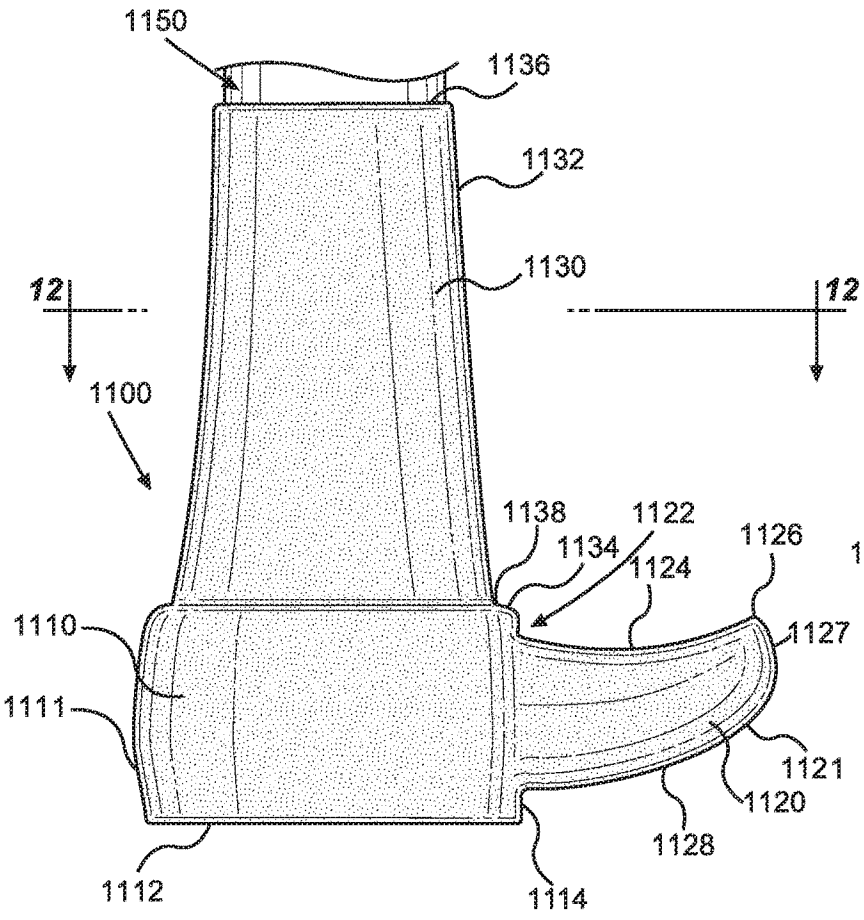
FIG. 11 illustrates a side elevation view of a handle and handle device according to an aspect of the present disclosure.

FIG. 11 illustrates a side elevation view of a handle 1150 and handle device 1100 according to an aspect of the present disclosure. FIG. 12 illustrates a cross-sectional view of the handle 1150 and the handle device 1100 of FIG. 11, taken along section line 12-12. The handle device 1100 includes a body 1110, a protrusion 1120, and an extended collar 1130 as illustrated in FIGS. 11 and 12.

The handle 1150 may be the handle of an instrument of any of the types described herein, and includes a handle end 1252 and a proximal shaft 1254. The handle end 1252 extends from an end face 1256 to a neck 1258 as shown in FIG. 12. The neck 1258 defining a transition between the proximal shaft 1254 and the handle end 1252.

The extended collar 1130 includes a collar body 1132 that extends from an upper end 1136 to a lower end 1134 for a length substantially equal to a length of the handle 1150. In one example a length of the collar body 1132 may substantially correspond to an area of an instrument including the handle 1150, for example a bat, that would be covered by a bottom and top hand of a user. In one example, the lower end 1134 may define a stepped surface that extends from an outermost diameter to a junction 1138 from which the collar body 1132 extends. In one example, the stepped surface of the lower end 1134 may be slanted or rounded to achieve particular ergonomic value.

It will be understood that the lower end 1134 may be considered an upper end, and part of, the body 1110. It will also be understood that for any of the examples described herein, a body, protrusion, and collar (non-extended or extended), may be formed as a monolithic structure from an elastic material.

The body 1110 defines a first outer surface 1111, and extends from a bottom circumferential surface 1112 to the lower end 1134 of the extended collar 1130. In the example illustrated, the first outer surface 1111 defines a substantially straight wall with little or no curvature. In one example, the first outer surface 1111 may define a cylindrical wall in a normal state (i.e., absent the handle 1150) that is flat as it extends from the bottom circumferential surface 1112 to the lower end 1134.

The protrusion 1120 of the handle device 1100 extends from a proximal protrusion end 1122 to a distal tip 1126 as illustrated. In particular, a body of the protrusion is defined between a first curved surface 1124, a second curved surface 1128, and a face 1127 that extends vertically there between and from the distal tip 1126. The face 1127 defining a radially outermost surface of the protrusion 1120 (and thus the handle device 1100) relative to a longitudinal axis of the handle device.

A first vertical distance defining a height of the body 1010 extends: (a) from a point corresponding to the bottom circumferential surface 1112; (b) to a level of a point of the body 1110 from which the lower end 1134 extends radially inward. This first vertical distance is designated as a first height $h_1$. A second vertical distance defining a height of the protrusion 1020 extends from the point corresponding to the bottom circumferential surface 1112 to a location corresponding to the distal tip and is designate as a second height $h_2$. In one example, the first and second heights $h_1$, $h_2$ may be equal as shown in FIGS. 11 and 12. Accordingly, the second height $h_2$ corresponding to the distal tip 1126 is less than a height of the junction 1138.

In other examples the second height $h_2$ may be equal to or greater than the height of the junction 1138. In yet other examples, the second height $h_2$ may be less than the first height $h_1$ In one example, the first and second curved surfaces 1124, 1128 may extend from respective vertical locations on the first outer surface 1111 such that a rim 1114 is defined by the first outer surface 1111 above and below the protrusion 1120. In another example, the first and second curved surfaces 1124, 1128 may extend from respective vertical locations (e.g. level with bottom circumferential surface 1112 and/or the lower end 1134) such that one or both of the rims are not provided.

In use, the first curved surface 1124 may receive, and substantial follow a curvature of, a base of a user's hand. The first curved surface 1124 may be provided as a concave surface 1124 having a radius of curvature corresponding to a curvature of a base of an "average" hand. More specifically, the curvature may be configured to have an ergonomic value dictated by an average hand structure for users of a particular instrument the handle device 1100 may be designed to secure to. With the base of the user's hand received on the first curved surface 1124, the protrusion 1120 may function to steady the user's hands during an implementation of an instrument including the handle 1150. Some or all of the advantages described with respect to other examples of a handle device according to the present disclosure may be provided by the handle device 1100 of FIGS. 11 and 12.

FIG. 12 provides a cross-sectional view of the handle device 1100. The body 1110 defines a first inner surface 1210, and the collar body 1132 defines a second inner surface 1232. The first inner surface 1232 includes an inner transition 1212, a middle section 1214, and an inner collar 1216. The first inner surface 1210, especially the transition 1212 and the middle section is configured to surround, conform to, and tightly fit to an outer surface 1253 of the handle end 1252. Likewise, the second inner surface 1232 is configured to surround, conform to, and tightly fit to an outer surface 1255 of the proximal shaft 1154. The transition 1212 is formed between the collar body 1132 and the body 1110. The transition may be sized to have a diameter and thickness that results in no or a minimal gap between the neck 1258 and the first and second inner surfaces 1210, 1232 at the transition 1212. As a result, the handle device 1100, even when subject to the application of significant forces from a user's hands, can remain in a same position relative to the handle 1150 and thereby steady a movement of the user's hands relative to the handle 1150.

In one example, an inner transition may be provided (formed) between the middle section 1214 and the inner collar 1216 such that a top edge of the inner collar 1216 is more pronounced. This added transition may function as a structure that assists in maintaining a position of a handle, such as handle 1150, relative to the inner surface 1210 along coincident longitudinal axes of the handle 1150 and handle device 1100. Thus, a capability of the handle device 1100 to remain in a same position relative to the handle 1150 and thereby steady a movement of the user's hands, may be improved.

The handle device 1100, like other examples described herein, may be formed of an elastic material that allows: the body 1210 and the collar body 1238 to stretch and receive the handle end 1252; the collar body 1238 to be pulled up the proximal shaft 1254; and the body 1210 to tightly fit around the handle end 1252. In the example shown in FIG. 12, a thickness 1234 of the collar body 1232 has a tapered configuration, and is thus smaller at the upper end 1136 than at the lower end 1134

Figure 14:
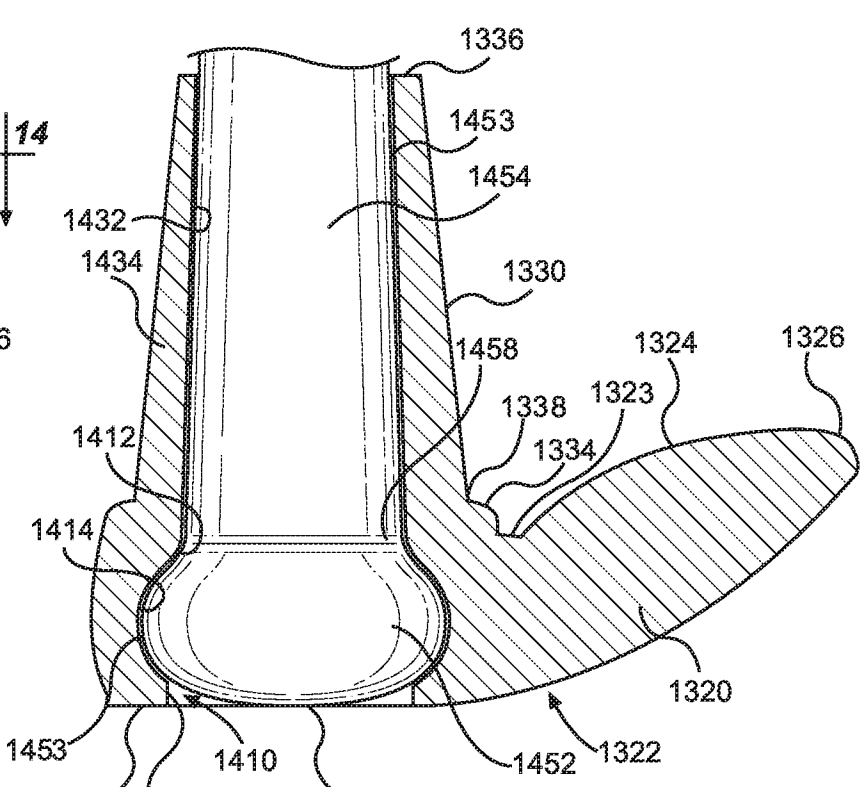
FIG. 14 illustrates a cross-sectional view of a handle and a handle device of FIG. 13, taken along section line 14-14.
Figure 13:
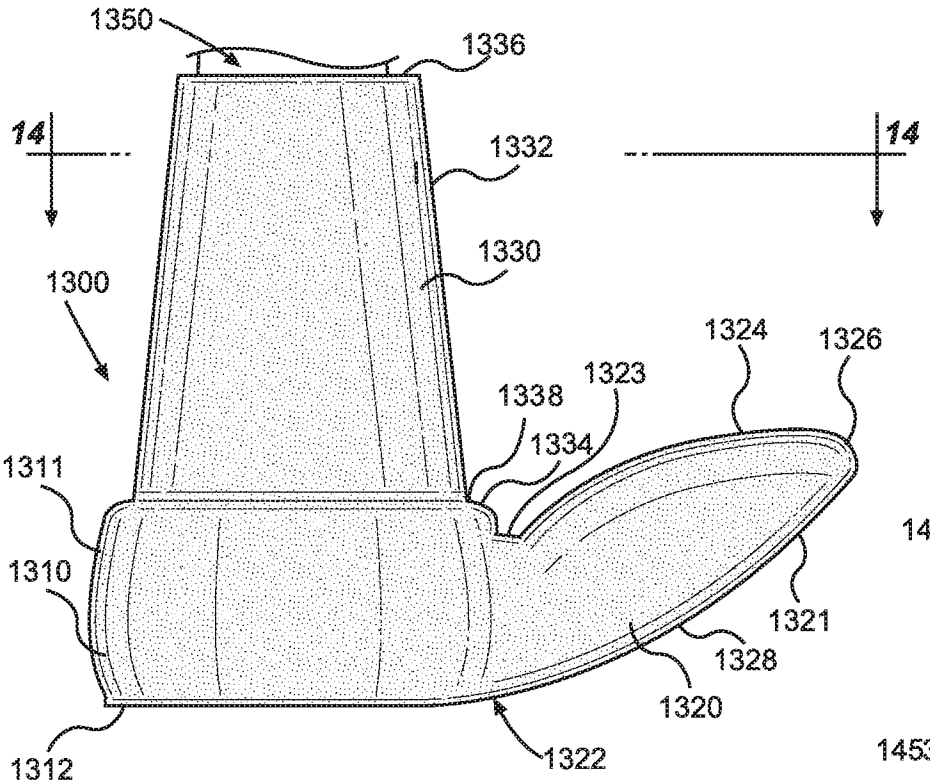
FIG. 13 illustrates a side elevation view of a handle and handle device according to an aspect of the present disclosure.
Figure 15:
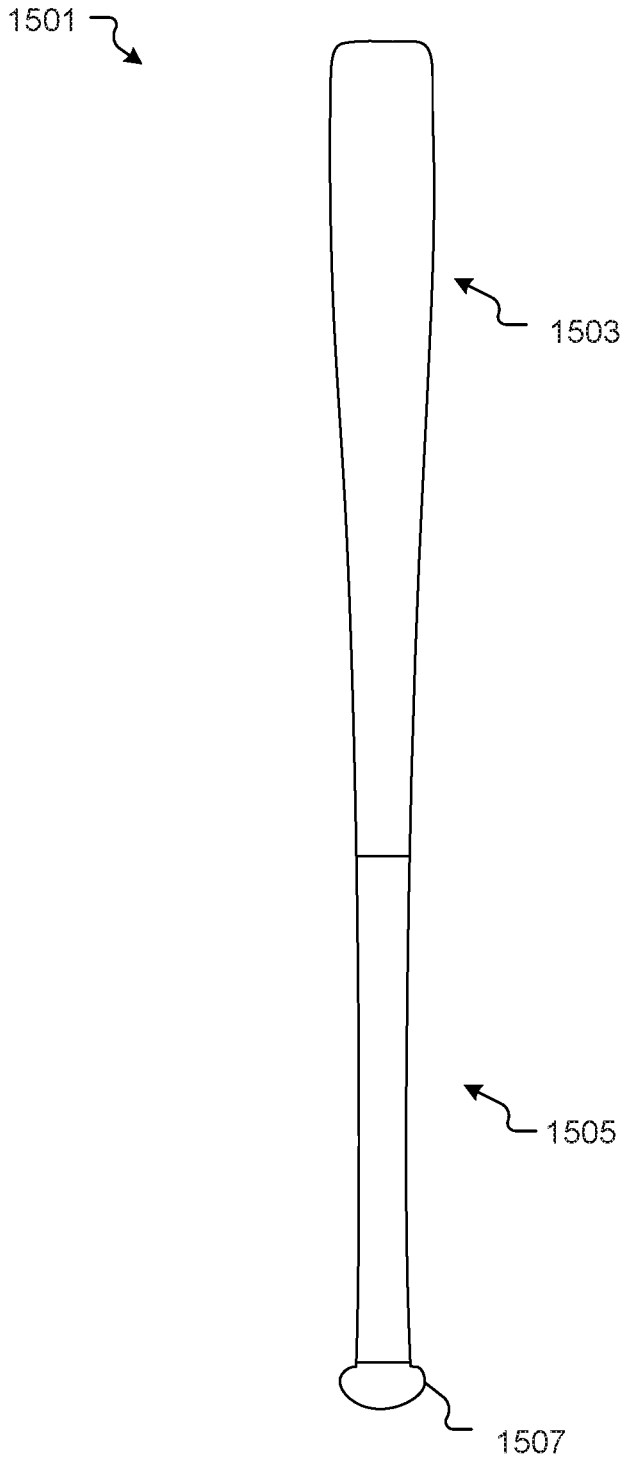
FIG. 15 RELATED ART
FIG. 15 is a front view of a common baseball bat.

FIG. 13 illustrates a side elevation view of a handle 1350 and handle device 1300 according to an aspect of the present disclosure. FIG. 14 illustrates a cross-sectional view of the handle 1350 and the handle device 1300 of FIG. 13, taken along section line 14-14. The handle device 1300 includes a body 1310, a protrusion 1320, and an extended collar 1330. The handle 1350 may be the handle of an instrument of any of the types described herein, and includes a handle end 1452 and a proximal shaft 1454. The handle end 1452 extends from an end face 1456 to a neck 1458 as shown in FIG. 14. The neck 1458 defining a transition between the proximal shaft 1454 and the handle end 1452.

The extended collar 1330 includes a collar body 1332 that extends from an upper end 1336 to a lower end 1334 for a length substantially equal to a length of the handle 1350. In one example a length of the collar body 1332 may substantially correspond to an area of an instrument including the handle 1350, for example a bat, that would be covered by a bottom and top hand of a user. In one example, the lower end 1334 may define a stepped surface that extends from an outermost diameter to a junction 1338 from which the collar body 1332 extends. In one example, the stepped surface of the lower end 1334 may be slanted or rounded to achieve a particular ergonomic value.

The body 1310 defines a first outer surface 1311, and extends from a bottom circumferential surface 1312 to the lower end 1334 of the extended collar 1330.

The protrusion 1320 of the handle device 1300 extends from a proximal protrusion end 1322 to a distal tip 1326 as illustrated. In particular, a body of the protrusion 1320 is defined between a first curved surface 1324, a second curved surface 1328 that converge at the distal tip 1326. In one example, a height of the distal tip 1326 relative to the bottom circumferential surface 1312, may be greater than a height of the junction 1338 and/or a level of a point of the body 1310 from which the lower end 1334 extends radially inward. In addition, the protrusion 1320 includes a landing or notch 1323 ("notch 1323") that is formed between the body 1310 and a start of the first curved surface 1324.

In use, the first curved surface 1324 may be provided as a convex surface 1324, as illustrated in order to resistively (but elastically) abut, and press against, a base of a user's hand. This configuration may be desirable for users whose hands get very "loose" when moving an object around which their hand or hands are wrapped. This may be the case for individuals recovering from a hand injury or a surgical procedure performed on their hand. Others may lack muscle strength or have a condition, such as Parkinson's disease, that makes controlling the movement of theirs difficult. Accordingly, these individuals may require an increased steadying force to be applied to a hand used to hold and implement an instrument as described herein. The protrusion 1320 of the handle device 1300 may provide such and increased opposing and steadying force.

The notch 1323 may be configured such that a cross-sectional area of a slice of the protrusion immediately adjacent to a plane from which the protrusion 1320 extends from the body 1310, is less than a cross-sectional area of a slice of the protrusion 1320 at a beginning of the first curved surface 1324. In a mechanical sense, the notch 1323 may therefore provide a fulcrum about which the protrusion 1320 can more easily pivot (or give) than if the notch 1323 were not provided. This may allow an increased amount of flexion of the protrusion 1320 which a particular user may desire.

FIG. 14 provides a cross-sectional view of the handle device 1300. The body 1310 defines a first inner surface 1410, and the collar body 1332 defines a second inner surface 1432. The first inner surface 1432 includes an inner transition 1412, a middle section 1414, and an inner collar 1416. The first inner surface 1410, especially the transition 1412 and the middle section is configured to surround, conform to, and tightly fit to an outer surface 1453 of the handle end 1452. Likewise, the second inner surface 1432 is configured to surround, conform to, and tightly fit to an outer surface 1455 of the proximal shaft 1354. The transition 1412 is formed between the collar body 1332 and the body 1310. The transition 1412 may be sized to have a diameter and thickness that results in no or a minimal gap between the neck 1458 and the first and second inner surfaces 1410, 1432 at the transition. As a result, the handle device 1300, even when subject to the application of significant forces from a user's hands, can remain in a same position relative to the handle 1350 and thereby steady a movement of the user's hands relative to the handle 1350.

Figure 16A:
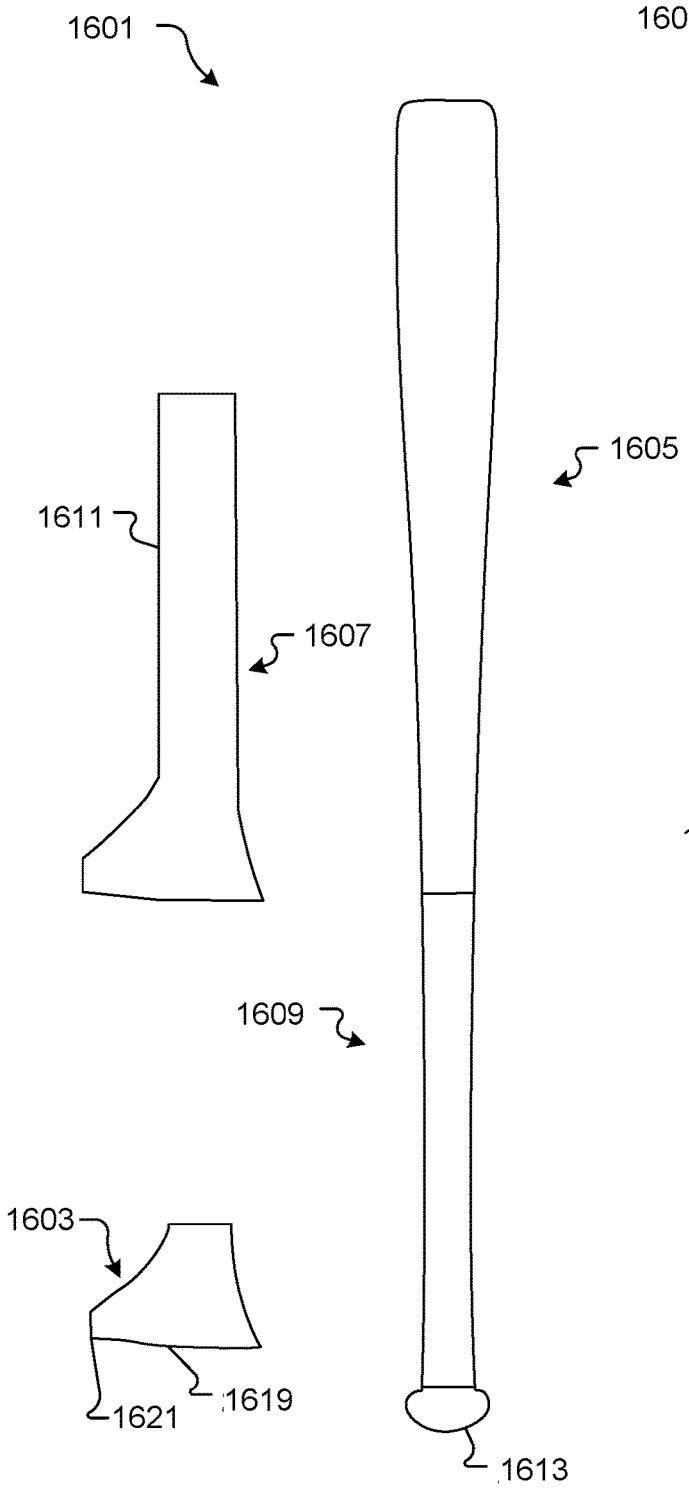
FIG. 16A illustrates a component view of a baseball bat control system in accordance with an aspect of the present application, and a front view of a bat.
Figure 16B:
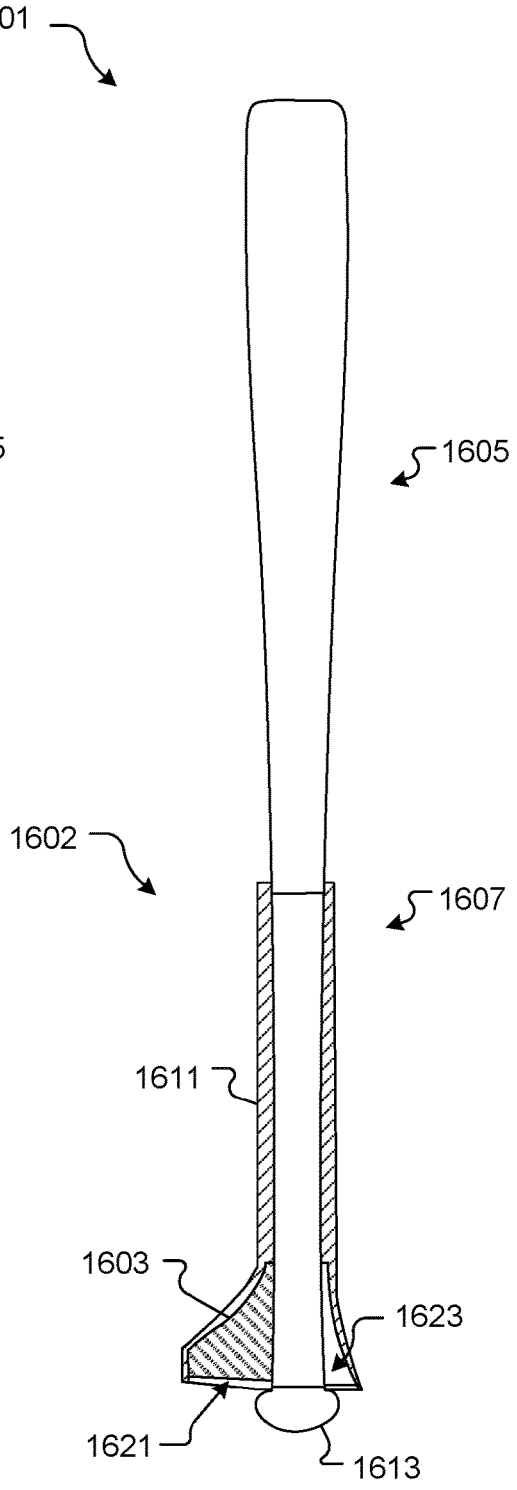
FIG. 16B illustrates a cross-sectional view of the baseball bat control system of FIG. 16A in accordance with aspects of the present application.

FIGS. 16A and 16B depict a front view and a cross-sectional front view respectively of a baseball bat control system in accordance with a preferred embodiment of the present application. It will be appreciated that system 1601 overcomes one or more of the above-listed problems commonly associated with conventional baseball bats.

In the contemplated embodiment, system 1601 includes control apparatus 1602 having a shaped insert 1603 removably attached to the handle 1609 of a baseball bat 1605 via a sleeve 1607. The sleeve 1607 is elastically attached to the handle 1609 of the baseball bat 1607. It should be appreciated that although control apparatus 1602 is shown in use with a baseball bat, alternative devices with similar handles are contemplated to be altered via the control apparatus 1602.

The sleeve 1607 having a body 1611 configured to slide over the knob 1613 of the baseball bat. The sleeve also having a pocket 1615 within the interior of the body 1611 configured to hold a shaped insert 1603 above the knob 1613 and against the handle 1609 of the baseball bat 1605. It is contemplated and will be appreciated that body 1611 of sleeve 1607 could be made from a material that also improves the grip of the players hands around sleeve 1607. It should be appreciated that shaped insert 1603 can vary in dimensions as desired for functional or manufacturing considerations.

The shaped insert 1603 having a body 1619 with at least one protrusion 1621 that alters the grip of the handle 1609 of the baseball bat 1605. The body 1619 also has a cutout 1623 that conforms to the handle 1609 and assists the sleeve 1607 in holding the shaped insert 1603 against the handle 1609.

It should be appreciated that one of the unique features believed characteristic of the present application is that the protrusion 1621 of the shaped insert 1603 enables the player to apply additional force to the baseball bat 1605 by providing additional leverage. Additionally the shaped insert 1603 facilitates the player maintaining their hands in the proper position during the complete swing of the baseball bat 1605.

Figure 17:
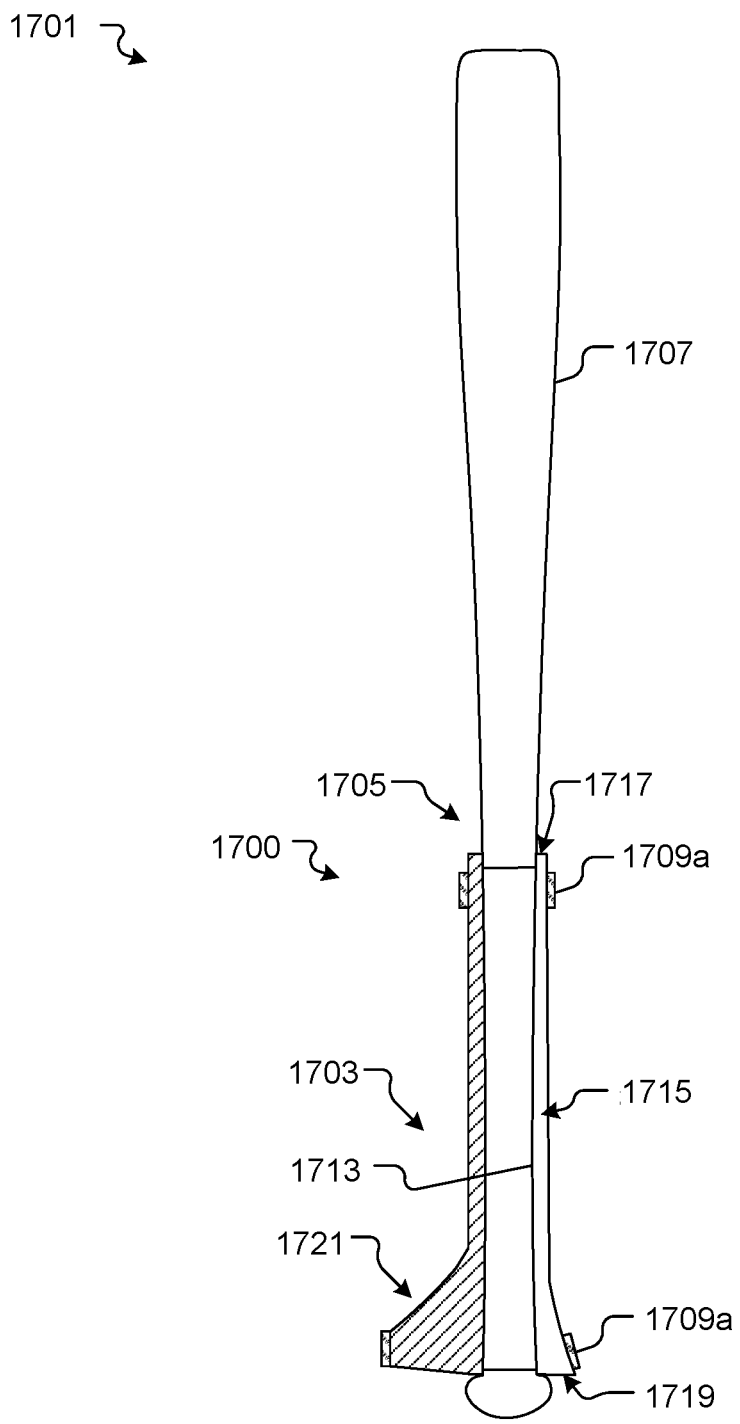
FIG. 17 is a cross-sectional view a baseball bat control system according to an aspect of the present application.

Referring now to FIG. 17, an alternative embodiment of a control system 1701 is depicted. Embodiment 1701 including a control apparatus 1700 having a body 1703 removably attached to the handle 1705 of a baseball bat 1707 by a plurality of bands 1709*a-b*.

The body 1703 having a cylindrical cavity 1713 that fits around the handle 1705 of the baseball bat 1707. The body 1703 can have a break 1715 from the top end 1717 to the bottom end 1719 of the body 1703 that enables the apparatus 1700 to be attached to the baseball bat 1707. The body 1703 is made of a material that allows the apparatus 1700 to flex open to fit around the baseball bat 1707. The body having at least one protrusion 1721 integral to and extending outward from the body 1711 that alters the shape of the grip associated with handle 1705. It is contemplated and will be appreciated that apparatus 1700 could be attached to the grip by adhesive, fasteners or the like without the use of bands 1709.

Figure 18:
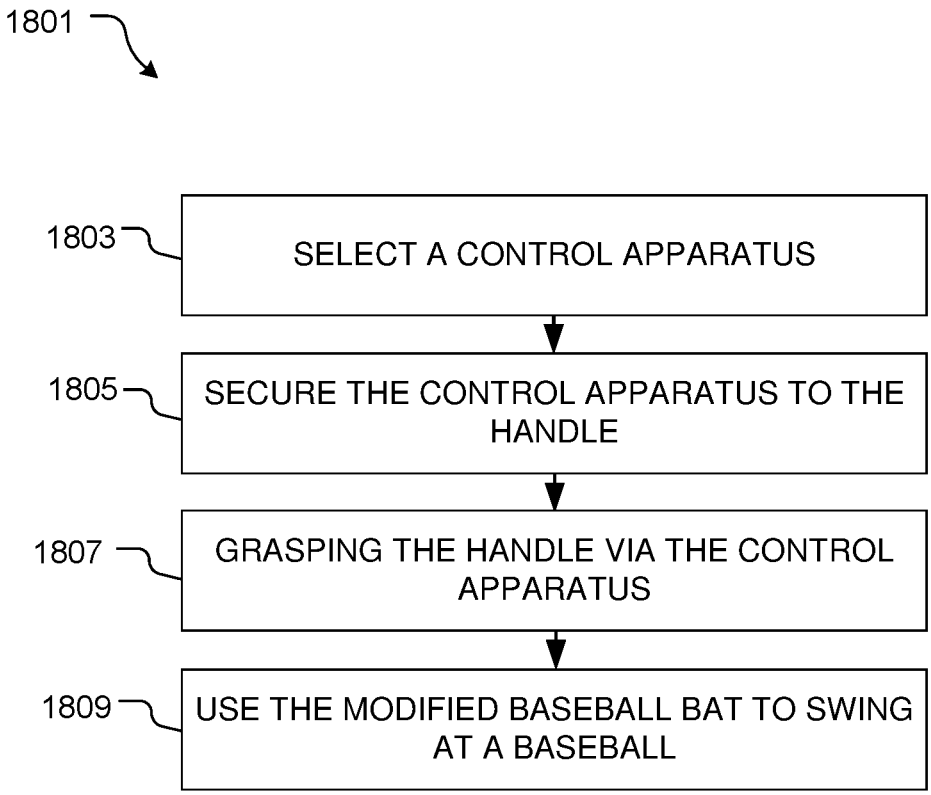
FIG. 18 is a flowchart of a preferred method of use of a baseball bat control system according to the present disclosure

Referring now to FIG. 18, the preferred method of use of the system 1601 is depicted. Method 1801 including selecting a control apparatus, securing the control apparatus to a handle of a baseball bat (or other similar device), wherein the control apparatus alters the shape of the grip associated with the baseball bat, as shown with boxes 1803, 1805. The baseball bat handle is grasped and used to swing the baseball bat (or other similar device), as shown with boxes 1807, 1809.

Figure 19:
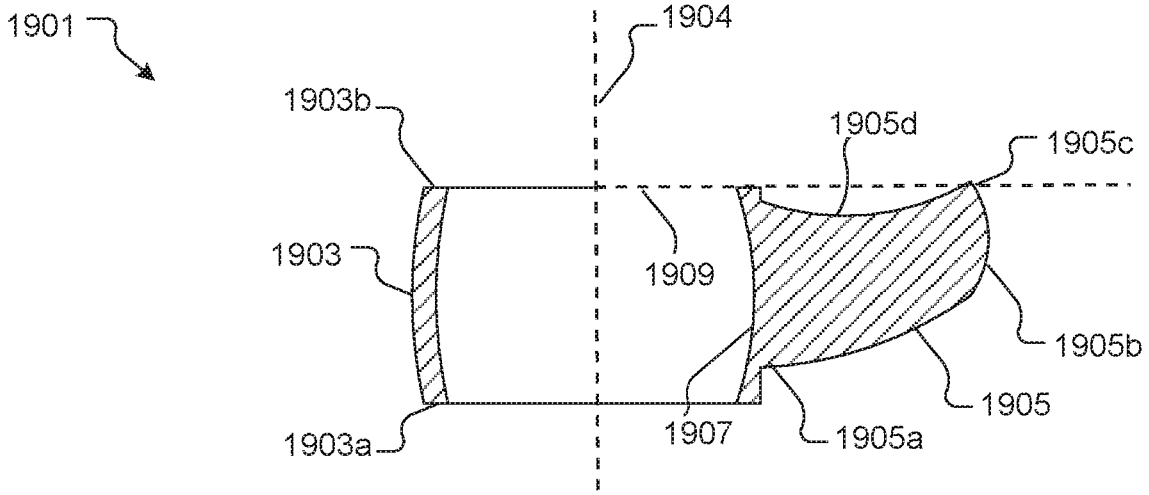
FIG. 19 is a cross-sectional side view of an alternative embodiment of a control apparatus in accordance with the present application.

Referring now to FIG. 19 an alternative embodiment of a control apparatus 1901 is depicted. Embodiment 1901 includes a sleeve body 1903 with an inner cavity 1907 configured to fit around the knob of a baseball bat. As illustrated in FIG. 19, the sleeve body 1903 extends along an axis 1904 from a first end 1903*a* to a second end 1903*b*. The sleeve body 1903 also having a protrusion 1905 extending away from the sleeve body 1903 from a proximal end 1905*a* at the sleeve body 1903, to a distal end 1905*b* that defines a distal tip 1905*c*. The protrusion 1905 defining a surface 1905*d* between the proximal end 1905*a* and the distal tip 1905*c* whereupon the hand and fingers of the user rest during use. In the embodiment 1901 the protrusion 1905 extends away from the sleeve body 1903 at about 90 degrees. As indicated by reference line 1909, the protrusion 1905 extends away from the sleeve body 1903 and defines a shape such that, the distal tip 1905*c* extends past the first end 1903*a* and is at least level with the second end 1903*a* of the sleeve body 1903 along the axis 1904.

In the embodiment 1901 the protrusion 1905 extends away from the sleeve body 1903 at about 90 degrees. It should be appreciated that embodiment 1901 is configured to function in a same or similar fashion to the control apparatus of system 1601 by altering a grip associated with a handle of a baseball bat (or other similar device). Protrusion 1905 provides a means of adding additional leverage to the baseball bat by the user.

It is contemplated that the sleeve body 1903 is composed of an elastic material to slide over the knob of the baseball bat. It will be understood that although an elastic sleeve body 1903 is contemplated other means of attaching the embodiment 1901 to a baseball are also contemplated.

Figure 20:
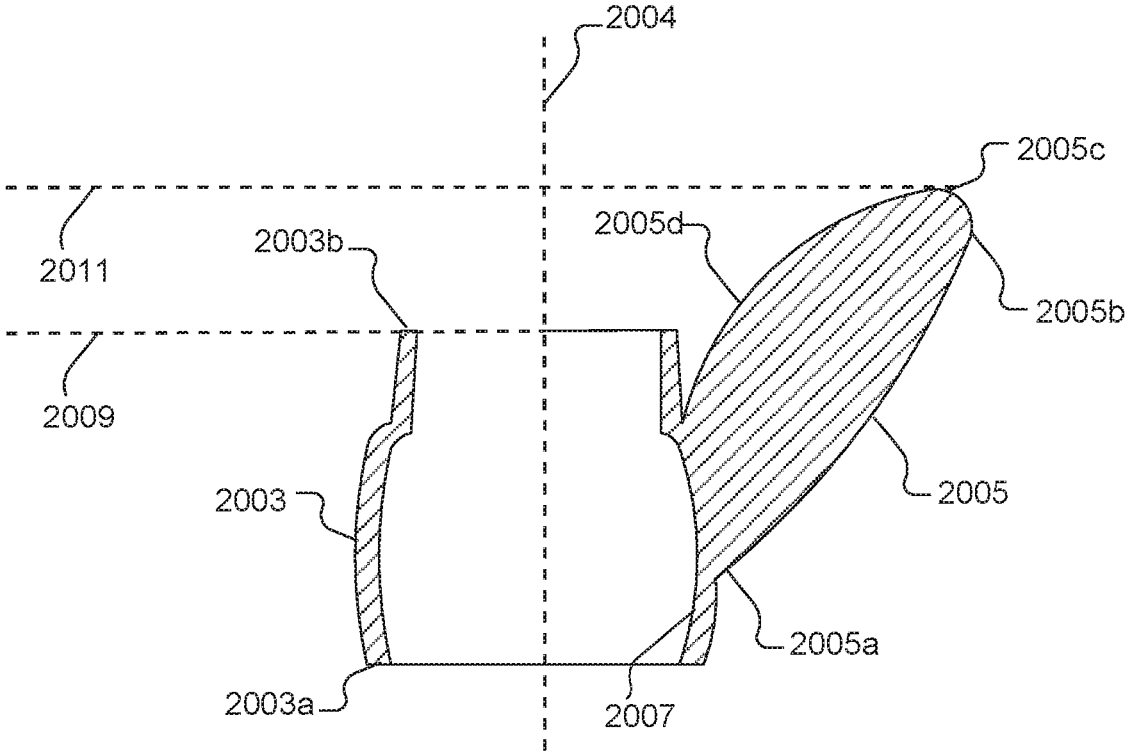
FIG. 20 is a cross-sectional side view of an alternative embodiment of a control apparatus in accordance with the present application.

Referring now to FIG. 20, an alternative embodiment 2001 having the same features as embodiment 1901 is depicted. Embodiment 2001 includes a sleeve body 2003 with an inner cavity 2007 configured to fit around the knob of a baseball bat. As illustrated in FIG. 20, the sleeve body 2003 extends along an axis 2004 from a first end 2003*a* to a second end 2003*b*. The sleeve body 2003 also having a protrusion 2005 extending away from the sleeve body 2003 from a proximal end 2005*a* at the sleeve body 2003, to a distal end 2005*b* that defines a distal tip 2005*c*. The protrusion 2005 defining a surface 2005*d* between the proximal end 2005*a* and the distal tip 2005*c* whereupon the hand and fingers of the user rest. In the current embodiment 2001 the protrusion 2005 extends away from the sleeve body 2003 at about 45 degrees. FIG. 20 illustrates a first reference line 2009 and a second reference line 2011 that correspond, respectively, to locations along the axis 2004 of the second end 2003*b* of the sleeve body 2003 and the distal tip 2005*c* of the protrusion 2005. As illustrated by the first and second reference lines 2009, 2011, the distal tip 2005*c* extends past the first end 2003*a* and the second end 2003*b* of the sleeve body 2003 along the axis 2004. Accordingly, the protrusion 2005 extends past a location that is at least level with the second end 2003*b* of body 2003 along the axis 2004. It should be appreciated that the protrusions can vary in size and dimensions as desired by aesthetical, function, or manufacturing considerations require.

Figure 21:
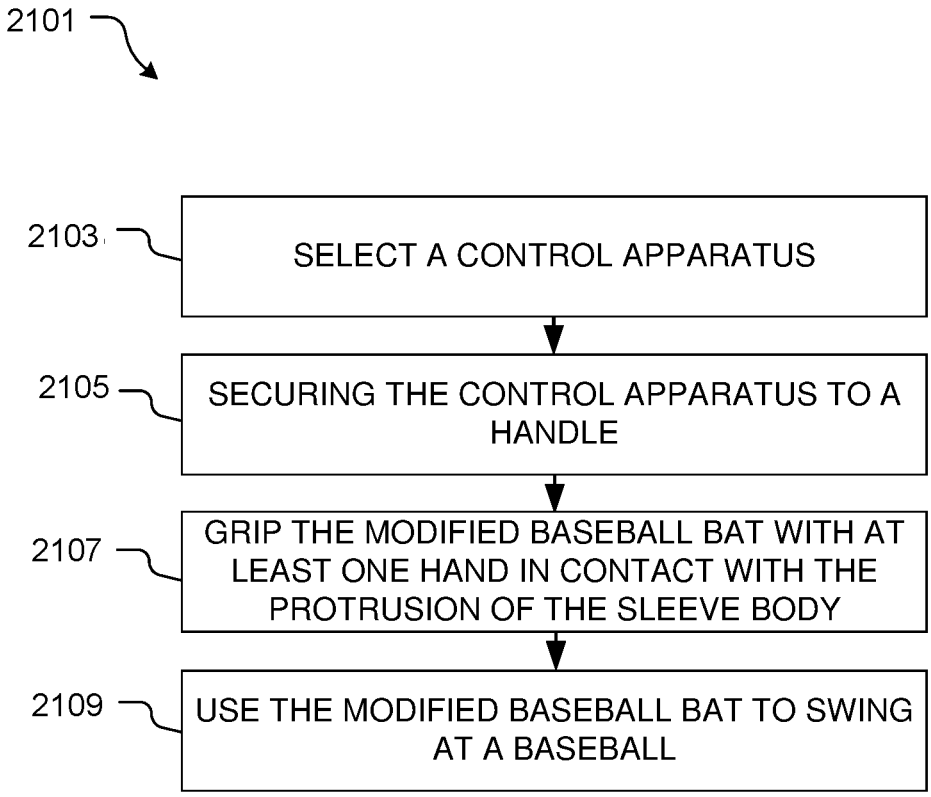
FIG. 21 is a flowchart of the preferred method of use of the apparatuses of FIGS. 19 and 20.

The preferred method of using the control apparatuses 1901 and 2001 are depicted in FIG. 21. Method 2101 including selecting the desired control apparatus and securing the selected control apparatus to the handle of a baseball bat (or similar device), as shown with boxes 2103, 2105. The user can then grip the modified baseball bat with at least one hand in contact with the protrusion of the sleeve body and use the baseball bat to swing at a baseball, as shown with boxes 2107, 2109.

Figure 22:
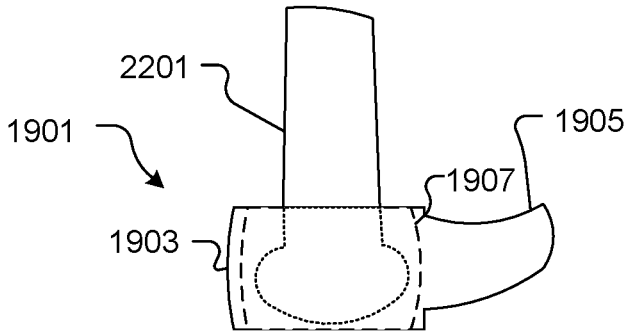
FIG. 22 is a front view of the control apparatus of FIG. 19 secured to a baseball bat.
Figure 23:
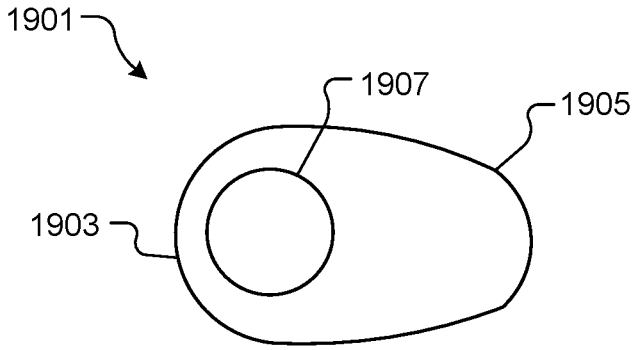
FIG. 23 is a top view of the control apparatus of FIG. 19.

FIG. 22 depicts a front view of control apparatus 1901 secured to a bat 2201, wherein the knob of bat 2201 is secured within the cavity 1907 of apparatus 1901. FIG. 23 depicts a top view of apparatus 1901, further demonstrating the features discussed above in connection with FIG. 19. It should be appreciated that apparatus 1901 is composed of a flexible material, thereby allowing for cavity 1907 to receive bat 2201 securely.

Figure 24A:
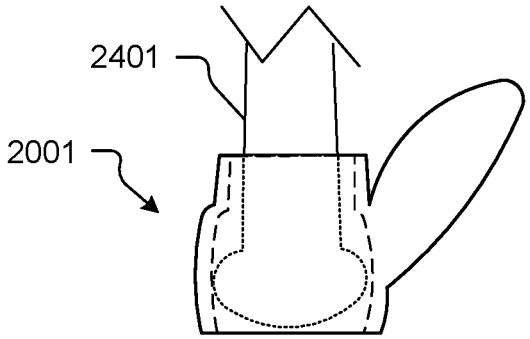
FIGS. 24A and 24B are front views of the control apparatus of FIG. 20 secured to a baseball bat.
Figure 24B:
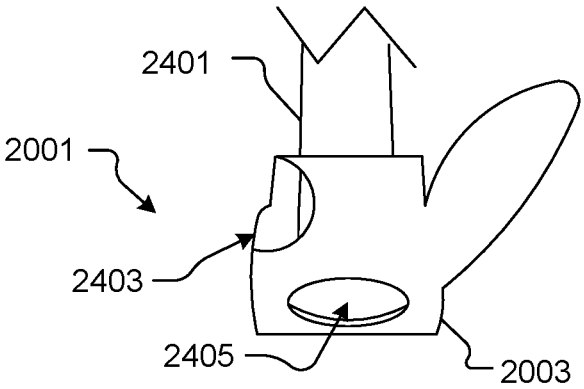

In FIGS. 24A and 24B, front views depicts apparatus 2001 secured to a bat 2401. FIG. 24A demonstrates how the knob of bat 2401 fits within the inner cavity of apparatus 2001 and FIG. 24B demonstrates the exterior of body 2003, wherein body 2003 can include one or more cut outs 2403, 2405 thereby providing greater flexibility in body 2003, allowing for securement of apparatus 2001 to bat 2401.

The system and method of use will be understood, both as to its structure and operation, from the accompanying drawings, taken in conjunction with the accompanying description. It should be understood that various components, parts, and features of the different examples may be combined together and/or interchanged with one another, all of which are encompassed by the present disclosure, even though not all variations and particular examples are shown in the drawings.

Further, other examples of the disclosure will be apparent to those skilled in the art from consideration of the specification and practice of the examples disclosed herein. Though some of the described methods have been presented as a series of steps, it should be appreciated that one or more steps can occur simultaneously, in an overlapping fashion, or in a different order. The order of steps presented is only illustrative of the possibilities and those steps can be executed or performed in any suitable fashion. Moreover, the various features of the examples described here are not mutually exclusive. Rather any feature of any example described here can be incorporated into any other suitable example. It is intended that the specification and examples be considered as exemplary only, with a true scope and spirit of the disclosure being indicated by the following claims.

What is claimed is:

1. A handle grip control device ("handle device") configured to be removably secured to a handle of an instrument, the handle device comprising:

a body having a first end, a bottom surface, a first outer surface, and an inner surface, the inner surface defining a cavity configured to receive handles of instruments, the body extending along a respective longitudinal axis from the first end to the bottom surface; and a protrusion extending radially outwardly from a respective proximal end at the first outer surface of the body to a distal tip, wherein the body includes an annular segment disposed along the longitudinal axis between the proximal end and the first end, the annular segment defining a portion of the outer surface having an outer circumference that increases along the longitudinal axis in a direction extending from the first end towards the proximal protrusion end, wherein the protrusion defines a second outer surface including a first sloped surface, a second sloped surface, and a bottom surface opposite to the first and second sloped surfaces, wherein the bottom surface defines a flat planar surface, wherein the first sloped surface extends over a first length from the proximal end at a lower end of the annular segment and the second sloped surface extends over a second length from an end of the first length to the distal tip, wherein a slope of the first sloped surface defines a first angle relative to a plane that extends parallel to the bottom surface and is perpendicular to the longitudinal axis of the body, and wherein a slope of the second sloped surface defines a second angle relative to the plane that is greater than the first angle.

2. The handle device of claim 1, wherein the body and the protrusion define a monolithic structure formed from an elastic material.

3. The handle device of claim 1, wherein a widest portion of the first sloped surface is sized to have a first width that is greater than a widest portion of the second sloped surface having a second width.

4. The handle device of claim 1, wherein the second length is greater than the first length.

5. The handle device of claim 1, wherein the inner surface of the body is a smooth continuous surface.

6. The handle device of claim 1, wherein the inner surface includes:

a first segment defined between a first ridge and a first end of the body, a second segment extending from the first ridge down to a second ridge, and third segment extending from the second ridge down to a second end of the body, and wherein the second segment defines a concave surface that extends over a majority of the inner surface of the body.

7. The handle device of claim 1, wherein the body extends a first distance vertically from a first end to a second end, wherein a second distance between a vertical position of the distal tip along the longitudinal axis of the body and a position of the second end is greater than the first distance.

8. The handle device of claim 1, further comprising:

an extended collar that extends vertically from the body along the longitudinal axis, wherein the body extends a first distance from a bottom end of the handle device defined by the bottom surface to a transition defined between the body and the extended collar, wherein a second distance between a vertical position of the distal tip along the longitudinal axis of the body and a position of the bottom end is greater than or equal to a value of the first distance, and wherein the extended collar extends from the transition to a top end of the handle device over a third distance that is at least twice the second distance.

9. The handle device of claim 1, wherein a plurality of apertures are defined in a wall of the body that extends between the inner surface and the first outer surface.

10. A handle grip control device ("handle device") configured to be removably secured to a handle of an instrument, the handle device comprising:

a body having a bottom surface that defines a bottom end of the handle device, a first outer surface, and an inner surface, the inner surface defining a cavity configured to receive handles of instruments;

a protrusion extending radially outwardly from a respective proximal end at the first outer surface of the body to a distal tip; and an extended collar that extends vertically from the body along a longitudinal axis of the body to a first end of the handle device, the handle device extending along the longitudinal axis from the first end to the bottom surface, wherein the body extends a first distance from the bottom end to a transition defined between the body and the extended collar, wherein a second distance between a vertical position of the distal tip along the longitudinal axis of the body and a position of the bottom end is greater than or equal to a value of the first distance, wherein the extended collar extends from the transition to a top end of the handle device a third distance that is at least twice the second distance, wherein the body includes an annular segment disposed along the longitudinal axis between the proximal end and the first end, the annular segment defining a portion of the outer surface having an outer circumference that increases along the longitudinal axis in a direction extending from the first end towards the proximal protrusion end, and wherein the protrusion defines a second outer surface that includes at least a portion of the bottom surface, a first sloped surface that extends from the proximal end at a lower end of the annular segment, and a second sloped surface that extends from the first sloped surface to the distal tip.

11. The handle device of claim 10, wherein the body, the protrusion, and the extended collar define a monolithic structure formed from an elastic material.

12. The handle device of claim 10, wherein the inner surface of the body is a smooth continuous surface.

13. The handle device of claim 10, wherein the inner surface includes:

a first segment defined between a first ridge and a first end of the body, a second segment extending from the first ridge down to a second ridge, and third segment extending from the second ridge down to a second end of the body, and wherein the second segment defines a concave surface that extends over a majority of the inner surface of the body.

14. The handle device of claim 10, wherein at least one of the first sloped surface and the second sloped surface of the protrusion defines a concave surface that is opposite to the bottom surface.

15. The handle device of claim 14, wherein the concave surface extends between the proximal end to the distal tip having a uniform curved profile.

16. The handle device of claim 14, wherein the concave surface is the first sloped surface of the protrusion and extends over a first length from the proximal end, wherein the second sloped surface extends over a second length from an end of the first length to the distal tip, wherein a slope of the first sloped surface defines a first angle of inclination that is less than 45° relative to a plane that extends parallel to the bottom surface and is perpendicular to the longitudinal axis of the body, and wherein a slope of the second sloped surface defines a second angle of inclination relative to the plane that is greater than the first angle.

17. The handle device of claim 10, wherein the protrusion defines a second outer surface that includes a bottom surface and a convex surface that is:

opposite to the bottom surface, and disposed between the proximal end and the distal tip.

18. The handle device of claim 10, wherein the convex surface extends from the distal tip to a notch defined by the second outer surface between a proximal end of the convex surface and the proximal end of the protrusion.

19. A handle grip control device ("handle device") configured to be removably secured to a handle of an instrument, the handle device comprising:

a body having a first outer surface and an inner surface, the inner surface defining a cavity configured to receive handles of instruments; and a protrusion extending radially outwardly from a respective proximal end at the first outer surface of the body to a distal tip, wherein the body extends from a first end to a second end over a first distance along a longitudinal axis of the body, wherein a second distance that is different than the first distance, is defined between:

a vertical position of the distal tip along the longitudinal axis, and a position of the second end along the longitudinal axis, wherein the body includes an annular segment disposed along the longitudinal axis between the proximal end and the first end, the annular segment defining a portion of the first outer surface having an outer circumference that increases along the longitudinal axis in a direction extending from the first end towards the proximal protrusion end, wherein the protrusion defines a second outer surface that includes a bottom surface and two curved surfaces that opposite to the bottom surface, disposed between the proximal end at a bottom end of the annular segment and the distal tip, wherein the two curved surfaces have different respective angles of inclination, and wherein the body and the protrusion define a monolithic structure formed from an elastic material.

20. The system of claim 19, wherein the inner surface includes:

a first segment defined between a first ridge and a first end of the body, a second segment extending from the first ridge down to a second ridge, and third segment extending from the second ridge down to a second end of the body, and wherein the second segment defines a concave surface that extends over a majority of the inner surface of the body.

* * * * *